US010856707B2

(12) United States Patent
Peterson et al.

(10) Patent No.: US 10,856,707 B2
(45) Date of Patent: Dec. 8, 2020

(54) SHEET PRODUCT ROLL HOLDER WITH INTEGRATED FLOWABLE MATERIAL DISPENSING MECHANISM

(71) Applicant: GPCP IP HOLDINGS LLC, Atlanta, GA (US)

(72) Inventors: Eric Paul Peterson, Mount Horeb, WI (US); Ryan Andersen, Appleton, WI (US); Jacob Edward Malesky, Neenah, WI (US); Jon Charles Alling, Madison, WI (US); Gordon Keith Graham, III, Oshkosh, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

(21) Appl. No.: 16/456,324

(22) Filed: Jun. 28, 2019

(65) Prior Publication Data

US 2020/0015638 A1 Jan. 16, 2020

Related U.S. Application Data

(60) Provisional application No. 62/697,042, filed on Jul. 12, 2018.

(51) Int. Cl.
*A47K 10/32* (2006.01)

(52) U.S. Cl.
CPC ..... *A47K 10/32* (2013.01); *A47K 2010/328* (2013.01)

(58) Field of Classification Search
CPC .... A47K 10/32; A47K 10/322; A47K 10/328; A47K 10/3246; A47K 2010/328
(Continued)

(56) References Cited

U.S. PATENT DOCUMENTS 3,620,465 A 11/1971 Wyatt
3,865,271 A 2/1975 Gold
(Continued)

FOREIGN PATENT DOCUMENTS

WO WO2007112916 A1 10/2007
WO WO2008015497 A1 2/2008
(Continued)

*Primary Examiner* — Paul R Durand
*Assistant Examiner* — Andrew P Bainbridge
(74) *Attorney, Agent, or Firm* — Eversheds Sutherland (US) LLP

(57) ABSTRACT

A sheet product roll holder may include a support arm, a spindle, a flowable material container, and an automated flowable material dispensing mechanism. The support arm may define a first longitudinal axis. The spindle may be coupled to the support arm and define a second longitudinal axis extending transverse to the first longitudinal axis, and the spindle may be configured to rotatably support a roll of sheet product thereon. The flowable material container may be positioned at least partially within the spindle and define a third longitudinal axis extending coaxially with the second longitudinal axis, and the flowable material container may include a container body and a volume of a flowable material positioned within the container body. The automated flowable material dispensing mechanism may be positioned at least partially within the support arm and configured to dispense the flowable material from the flowable material container.

25 Claims, 13 Drawing Sheets

(58) Field of Classification Search
USPC ..... 222/36, 52, 63, 192, 644–649, 635, 222/325–327, 383.1, 504
See application file for complete search history.

(56) References Cited

U.S. PATENT DOCUMENTS

| | | | | |
|---|---|---|---|---|
| 3,910,229 | A | 10/1975 | Spencer | |
| 4,436,224 | A * | 3/1984 | McInerny | A47K 10/32 221/96 |
| 4,901,889 | A * | 2/1990 | Mitchell | A47K 10/32 222/153.11 |
| 4,964,543 | A * | 10/1990 | Scheiber | A47K 10/32 222/180 |
| 5,255,861 | A | 10/1993 | Lerner | |
| 5,312,021 | A * | 5/1994 | Nelson | A47K 10/32 221/96 |
| 5,465,878 | A | 11/1995 | Armijo | |
| 5,671,872 | A | 9/1997 | Daniels, Jr. | |
| 5,697,557 | A | 12/1997 | Blessing | |
| 5,727,579 | A | 3/1998 | Chardack | |
| 5,819,989 | A | 10/1998 | Saraceni | |
| 5,887,759 | A * | 3/1999 | Ayigbe | A47K 10/32 222/192 |
| 5,992,430 | A | 11/1999 | Chardack | |
| 6,092,760 | A | 7/2000 | Hedrick | |
| 6,138,874 | A | 10/2000 | Audrey | |
| 6,314,971 | B1 | 11/2001 | Schneider | |
| 6,319,318 | B1 | 11/2001 | Pekarek | |
| 6,346,153 | B1 | 2/2002 | Lake | |
| 6,401,972 | B1 | 6/2002 | Schlattl | |
| 6,698,616 | B2 * | 3/2004 | Hidle | A47K 5/1217 222/1 |
| 6,739,479 | B2 * | 5/2004 | Contadini | E03D 9/007 222/1 |
| 6,918,513 | B1 * | 7/2005 | Downey | A47K 10/32 222/192 |
| D520,788 | S | 5/2006 | Hoernig | |
| 7,037,020 | B2 | 5/2006 | Neuendorf | |
| D541,089 | S | 4/2007 | Massaud | |
| 7,311,221 | B2 | 12/2007 | Serfaty | |
| 7,438,257 | B2 | 10/2008 | Kennard | |
| 7,461,758 | B2 | 12/2008 | Serfaty | |
| 7,743,947 | B2 | 6/2010 | Flasch | |
| 7,837,060 | B2 | 11/2010 | Mullett | |
| 7,850,041 | B2 | 12/2010 | Amundson | |
| 7,896,196 | B2 * | 3/2011 | Wegelin | A47K 5/1217 222/52 |
| 7,900,334 | B2 | 3/2011 | Zimmerman | |
| D639,590 | S | 6/2011 | Sakuma | |
| 8,342,363 | B2 * | 1/2013 | Carpenter | A61L 9/14 222/52 |
| 8,479,957 | B2 * | 7/2013 | Ophardt | A47K 10/3818 222/144 |
| 8,783,601 | B1 | 7/2014 | Shala | |
| 9,085,438 | B2 | 7/2015 | Wilkins | |
| 9,237,831 | B1 | 1/2016 | Luu | |
| 9,271,616 | B2 | 3/2016 | Yaros | |
| 9,375,745 | B2 | 6/2016 | Finch | |
| 9,504,363 | B2 * | 11/2016 | Hoefte | B05B 11/00412 |
| 9,532,684 | B2 * | 1/2017 | Hoefte | A47K 10/38 |
| 9,579,000 | B1 | 2/2017 | Morris | |
| 9,585,522 | B1 | 3/2017 | Brown, Sr. | |
| 9,955,826 | B2 * | 5/2018 | Staub | A47K 5/14 |
| 10,293,353 | B2 | 5/2019 | Casper | |
| 2001/0023878 | A1 | 9/2001 | Irwin | |
| 2002/0079380 | A1 | 6/2002 | Presson | |
| 2002/0187276 | A1 | 12/2002 | Zhang | |
| 2003/0052136 | A1 | 3/2003 | Weng | |
| 2005/0039293 | A1 | 2/2005 | Mcreynolds | |
| 2005/0183194 | A1 | 8/2005 | Haile, Jr. | |
| 2007/0034650 | A1 | 2/2007 | Pulch | |
| 2007/0278242 | A1 | 12/2007 | Amundson | |
| 2008/0011782 | A1 | 1/2008 | Sidman | |
| 2008/0087680 | A1 | 4/2008 | Amundson | |
| 2008/0098513 | A1 | 5/2008 | Hardway | |
| 2008/0257906 | A1 | 10/2008 | Orgna | |
| 2009/0031952 | A1 | 2/2009 | Lazar | |
| 2009/0101665 | A1 | 4/2009 | Mulhern | |
| 2009/0217870 | A1 | 9/2009 | Luu | |
| 2009/0302049 | A1 | 12/2009 | Cornell | |
| 2010/0068092 | A1 | 3/2010 | Larsson | |
| 2010/0108798 | A1 | 5/2010 | Louis | |
| 2010/0243673 | A1 * | 9/2010 | Furner | B65D 83/262 222/1 |
| 2010/0301136 | A1 | 12/2010 | Scott | |
| 2011/0042486 | A1 | 2/2011 | Luft | |
| 2011/0068196 | A1 | 3/2011 | Flasch | |
| 2011/0315715 | A1 | 12/2011 | Ophardt | |
| 2013/0126549 | A1 | 5/2013 | Ader | |
| 2014/0318448 | A1 | 10/2014 | Hug | |
| 2014/0339281 | A1 | 11/2014 | Flocchini | |
| 2015/0125343 | A1 | 5/2015 | Hall | |
| 2015/0196173 | A1 * | 7/2015 | Hoefte | A47K 5/1211 222/153.01 |
| 2015/0272404 | A1 | 10/2015 | Jeon | |
| 2016/0183744 | A1 | 6/2016 | Sadikov | |
| 2016/0309969 | A1 | 10/2016 | Brants | |
| 2020/0015638 | A1 * | 1/2020 | Peterson | A47K 10/32 |

FOREIGN PATENT DOCUMENTS

| | | | |
|---|---|---|---|
| WO | WO2008029192 | A2 | 3/2008 |
| WO | WO2009135234 | A2 | 11/2009 |
| WO | WO2010017080 | A1 | 2/2010 |
| WO | WO2016018202 | A1 | 2/2016 |

* cited by examiner

SHEET PRODUCT ROLL HOLDER WITH INTEGRATED FLOWABLE MATERIAL DISPENSING MECHANISM

CROSS-REFERENCE TO RELATED APPLICATIONS

This application claims priority benefit of U.S. Provisional Application No. 62/697,042, filed on Jul. 12, 2018, which is incorporated by reference herein in its entirety.

FIELD OF THE DISCLOSURE

The present disclosure relates generally to product dispensers and more particularly to a sheet product roll holder having an integrated flowable material dispensing mechanism and related methods for dispensing sheet product and flowable material therefrom.

BACKGROUND

Various types of sheet product dispensers are known in the art, including mechanical and automated dispensers configured to dispense sheet product from a roll of sheet product that is rotatably supported by the dispenser. For example, a sheet product roll holder may include a spindle for rotatably supporting a roll of sheet product, and one or more support arms for mounting the roll holder to a wall or other support structure. Some roll holders may be mounted in various locations for convenient use, such as near a toilet, a sink, or other locations where users may frequently use sheet product. Other roll holders may be portable, such that the roll holder may be moved from one location to another, as desired. Bath tissue, facial tissue, paper towels, napkins, wipes, and other types of sheet product may be provided in roll form for dispensing via sheet product roll holders.

In certain instances, users may desire to apply a flowable material to a portion of sheet product to facilitate cleaning with the sheet product. For example, after obtaining bath tissue from a roll holder, some users may apply a flowable material, such as a cleansing spray or spritz, to the bath tissue to enhance personal cleaning. The cleansing spray often may be provided in a spray bottle which a user may keep in a bathroom in a drawer or near the toilet. Use of the spray bottle may be cumbersome and inconvenient, requiring the user to remove and replace a cap of the bottle to inhibit contamination. Further, the spray bottle may become misplaced or damaged and thus unavailable for use when desired. As another example, some users may desire to apply a soap, a cleaning solution, or other flowable materials to paper towels or other types of sheet product for general cleaning.

There remains a need for improved sheet product roll holders which allow for convenient and sanitary dispensing of flowable materials onto sheet product removed therefrom.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1A:
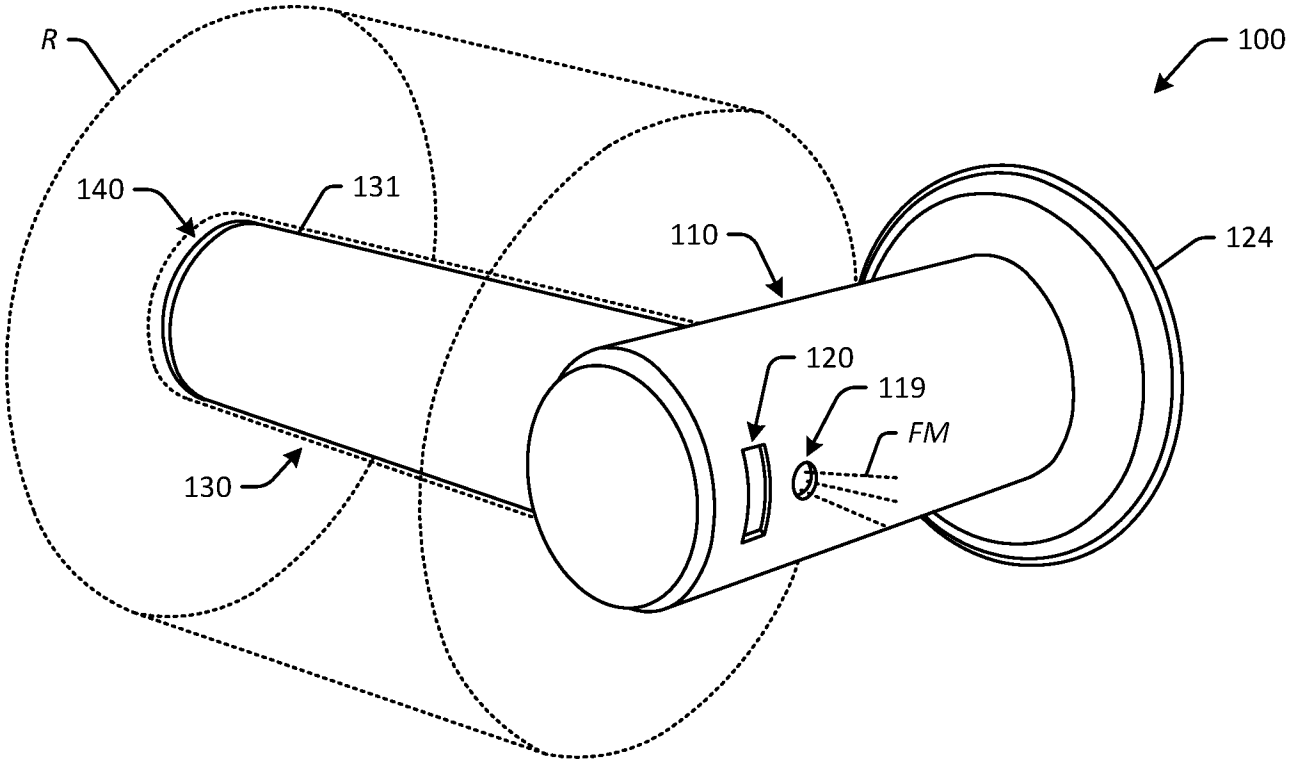
FIG. 1A is a perspective view of a sheet product roll holder having an integrated flowable material dispensing mechanism in accordance with one or more embodiments of the disclosure, showing a roll of sheet product supported by the roll holder in a horizontal orientation.

The sheet product roll holders provided herein advantageously include an integrated flowable material dispensing mechanism to allow a user to conveniently and easily apply a flowable material to a portion of sheet product obtained from the roll holder. In certain embodiments, as described in detail below, the roll holder may include a support arm and a spindle coupled to the support arm for supporting a roll of sheet product. A flowable material container may be removably positioned within the spindle and arranged in a concentric manner with respect to the roll of sheet product, and a flowable material dispensing mechanism may be positioned within the support arm and configured to dispense the flowable material from the container and out of the support arm. In this manner, the roll holder may house the container and the dispensing mechanism in a concealed manner to inhibit contamination of the flowable material, while minimizing the overall size of the roll holder. In other embodiments, the container and the dispensing mechanism may be positioned within the spindle or the container and the dispensing mechanism may be positioned within the support arm.

The present disclosure includes non-limiting embodiments of sheet product roll holders having an integrated flowable material dispensing mechanism and related methods for dispensing sheet product and flowable material therefrom. The embodiments are described in detail herein to enable one of ordinary skill in the art to practice the roll holders and methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "flowable material" refers to any material, such as a liquid, gel, or foam material, that is able to move or be moved along in a flow. Examples of flowable materials include, but are not limited to, soap, sanitizer, cleanser, air freshener, shampoo, body wash, lotion, or other skincare or personal hygiene products, condiments or other foodservice products, or cleaning products, whether in the form of a liquid, gel, foam, or combinations thereof. In some embodiments, the flowable material may be stored in one form, such as a liquid, and dispensed in the same form. In some embodiments, the flowable material may be stored in one form, such as a liquid, and dispensed in another form, such as a foam.

As used herein, the term "sheet product" refers to a product that is relatively thin in comparison to its length and width and exhibits a relatively flat, planar configuration, yet is flexible or bendable to permit folding, rolling, stacking, or the like. Example sheet products include towel, bath tissue, facial tissue, napkin, wipe, or other sheet-like products. Sheet products may be made from paper, cloth, non-woven, metallic, polymer or other materials, and in some cases may include multiple layers or plies. In some embodiments, the sheet product may be a continuous sheet that is severable or separable into individual sheets using, for example, a tear bar or cutting blade, while in other cases the sheet product may include predefined areas of weakness, such as lines of perforations, that extend along the width of the sheet product to define individual sheets and facilitate separation or tearing.

The meanings of other terms used herein will be apparent to one of ordinary skill in the art or will become apparent to one of ordinary skill in the art upon review of the detailed description when taken in conjunction with the several drawings and the appended claims.

FIGS. 1A-1D illustrate a sheet product roll holder 100 having an integrated flowable material dispensing mechanism. The sheet product roll holder 100 is configured to support a roll R of sheet product to allow a user to obtain a portion of sheet product therefrom. In some embodiments, the sheet product may be bath tissue, although other types of sheet product may be used with the roll holder 100. The sheet product roll holder 100 also is configured to dispense a flowable material FM to allow a user to apply the flowable material FM to a portion of sheet product removed from the roll R. In some embodiments, the flowable material FM may be a cleanser used for personal cleaning, although other types of flowable materials may be used. The flowable material FM may be provided in a flowable material container 160 of the roll holder 100, which may be replaced upon depletion of the flowable material FM. As described below, the container 160 may be disposed within the roll holder 100, such that the container 160 is protected from contamination and damage. Further, the container 160 may be arranged for convenient dispensing of the flowable material FM onto a portion of sheet product obtained from the roll R, while minimizing the overall size of the roll holder 100 and providing an aesthetically clean appearance.

As shown, the sheet product roll holder 100 may include a support arm 110, a plate 124, a spindle 130, an end cap 140, a flowable material dispensing mechanism 150, and a flowable material container 160. The support arm 110 may be configured for mounting the roll holder 100 to a support structure, such as a wall or a cabinet, and also for supporting the other components of the roll holder 100. The support arm 110 may have an elongated shape defining a first longitudinal axis. For example, the support arm 110 may have a generally cylindrical shape, as shown, although other shapes may be used. In some embodiments, the support arm 110 may include multiple components attached to one another. For example, the support arm 110 may include a base portion 111 and a cap portion 112 that are removably attached to one another. The support arm 110 may define an interior space 113 for containing the dispensing mechanism 150 therein. As shown, the interior space 113 may be defined by the base portion 111 and the cap portion 112. In other embodiments, the support arm 110 may be a unitary structure.

The base portion 111 may include a base body 114 and a flange 115 extending radially outward from the base body 114. The base body 114 may define a portion of the interior space 113 and may include a longitudinal wall 116 extending parallel to the first longitudinal axis. The flange 115 may be configured for mounting to a support structure, such as a wall or a cabinet. For example, the flange 115 may include one or more mounting holes, as shown, to facilitate mounting of the roll holder 100 via one or more fasteners. The cap portion 112 may include an end wall 117 and a longitudinal wall 118 each defining a portion of the interior space 113. In some embodiments, the base portion 111 and the cap portion 112 may be removably attached to one via a snap-fit connection, although other removable attachment mechanisms may be used. In this manner, the cap portion 112 may be removed from the base portion 111 to access the dispensing mechanism 150, for example, to replace batteries thereof.

As shown, the support arm 110 may include one or more openings defined therein. For example, the support arm 110 may include a dispensing opening 119, a sensor opening 120, and a spindle opening 121. In some embodiments, the dispensing opening 119 and the sensor opening 120 may be defined in the cap portion 112, and the spindle opening 121 may be defined in the base portion 111, although other arrangements of the openings may be used.

The plate 124 may be formed as a ring-shaped member defining an aperture 125 therethrough. As shown, the aperture 125 may be sized to allow the plate 124 to slide over the base body 114 and be positioned over the flange 115. In this manner, upon mounting the base portion 111 to a support structure, the plate 124 may cover the mounting holes and the fasteners. The plate 124 may be removably attached to the flange 115 via a snap-fit or a friction-fit connection.

Figure 1B:
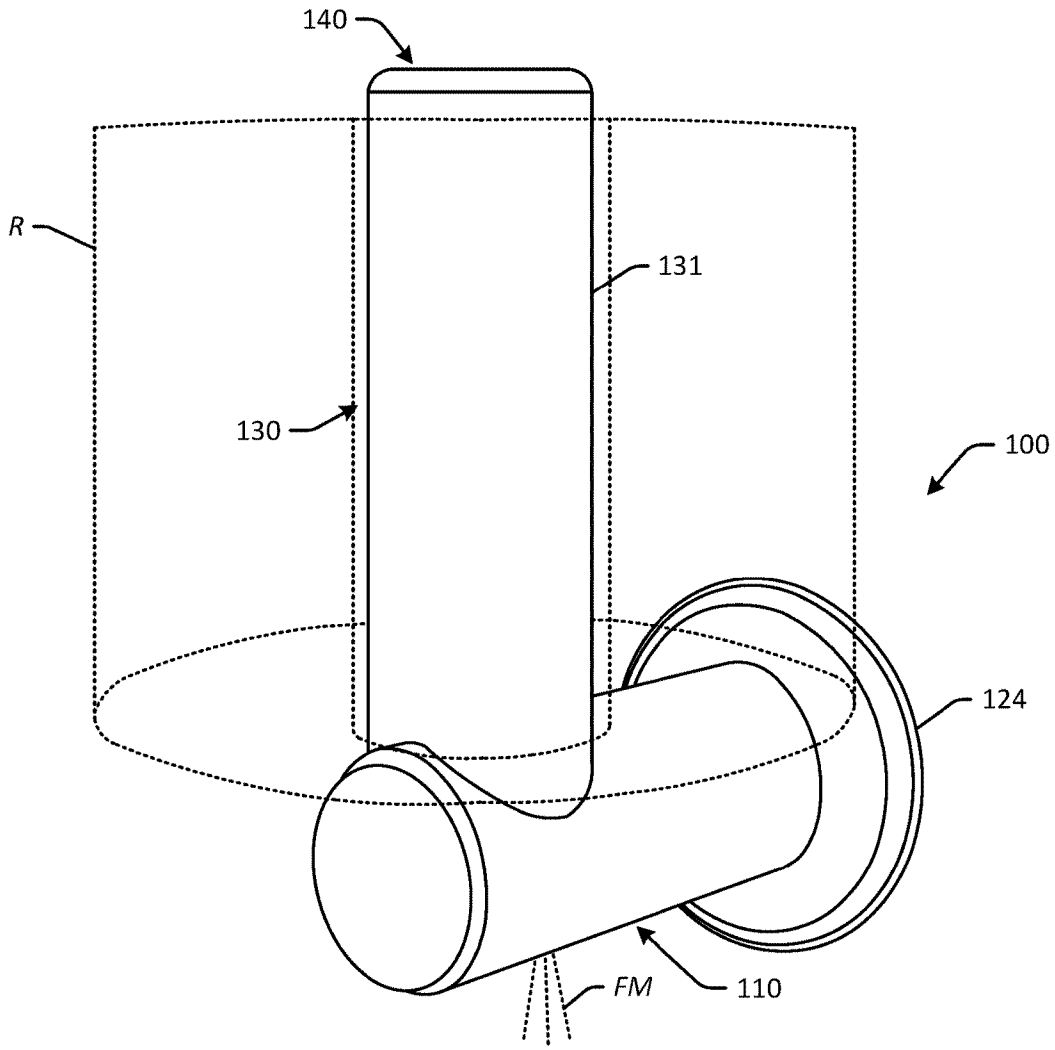
FIG. 1B is a perspective view of the roll holder of FIG. 1A, showing a roll of sheet product supported by the roll holder in a vertical orientation.

The spindle 130 may be configured to rotatably support the roll R of sheet product thereon. In particular, the spindle 130 may be configured to extend through at least a portion of a central aperture of the roll R, such that the roll R may rotate around the spindle 130 for dispensing the sheet product. The spindle 130 may have an elongated shape defining a second longitudinal axis. For example, the spindle 130 may have a generally cylindrical shape, as shown, although other shapes may be used. The spindle 130 may include a tubular body 131 and a flange 132 extending radially outward from the tubular body 131. The spindle 130 may define an interior space 133 extending from one end to the other end of the spindle 130 and configured to receive the flowable material container 160. As shown, the spindle 130 may be coupled to the support arm 110. The flange 132 may include one or more mounting holes to facilitate attachment of the spindle 130 to the support arm 110 via one or more fasteners, although other attachment mechanisms may be used. As shown in FIG. 1D, the flange 132 may be positioned within the interior space 113 of the support arm 110, a portion of the tubular body 131 may be positioned within the spindle opening 121, and a remainder of the tubular body 131 may extend away from the support arm 110. The second longitudinal axis of the spindle 130 may extend transverse to the first longitudinal axis of the support arm 110. For example, the second longitudinal axis may extend perpendicular to the first longitudinal axis, as shown.

The end cap 140 may be positioned at least partially within the interior space 133 of the spindle 130 at the free end thereof. In this manner, the end cap 140 may cover the free end of the interior space 133 and the flowable material container 160 positioned therein. The end cap 140 may be removably attached to the spindle 130. For example, the end cap 140 may include one or more locking protrusions 141 configured to engage mating internal slots in the spindle 130 to form a partial-turn locking mechanism. The end cap 140 may be removed, for example, to replace the flowable material container 160 upon depletion of the flowable material therein. The end cap 140 may facilitate positioning of the flowable material container 160 within the spindle 130, causing the container 160 to engage the dispensing mechanism 150, as described below. In some embodiments, a compressible member 142 may be positioned between the end cap 140 and the container 160 and configured to bias the container 160 toward the dispensing mechanism 150. The compressible member 142 may be a compression spring, although other types of compressible components may be used. The end cap 140 may include a bore 143 that receives a portion of the compressible member 142 therein.

Figure 1C:
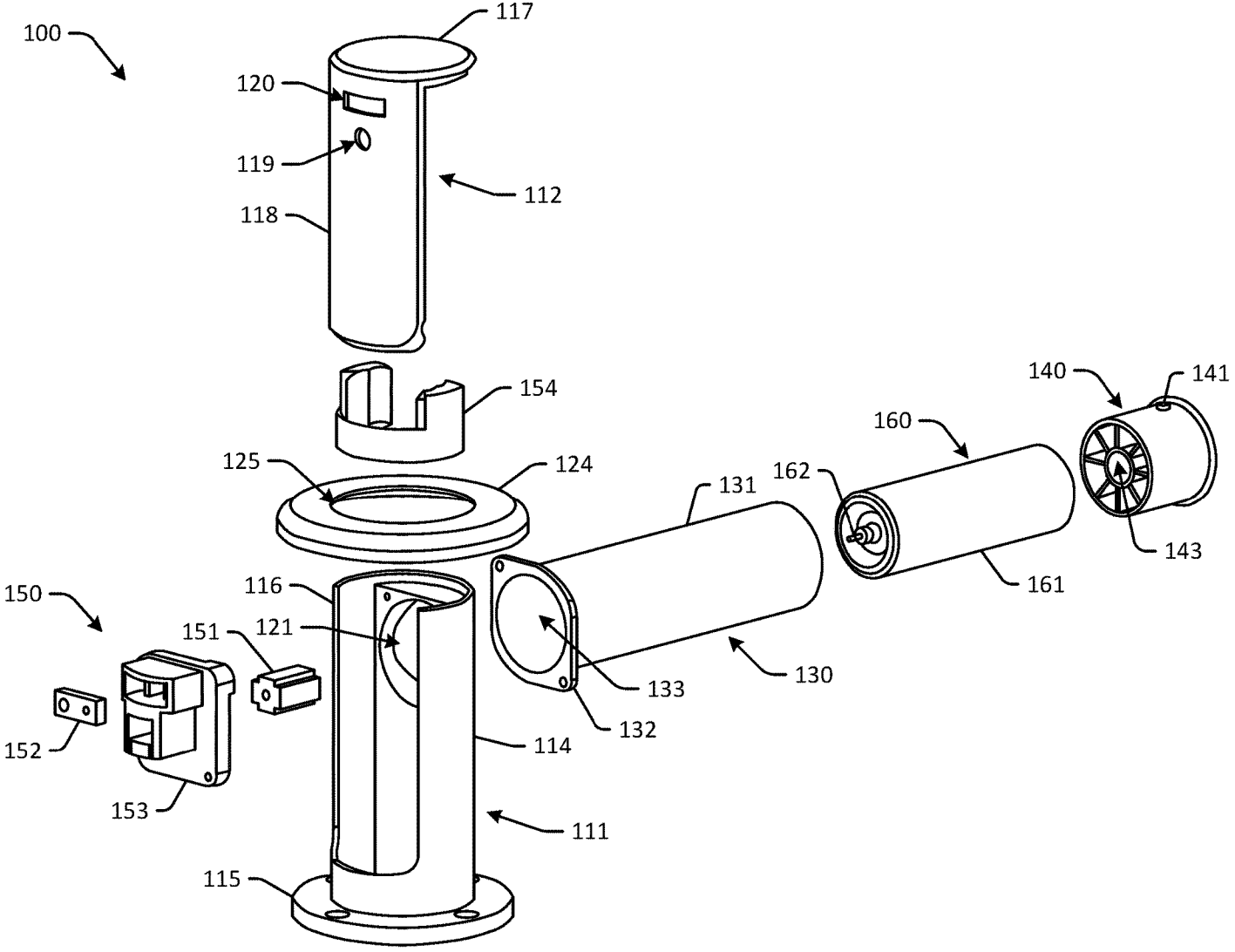
FIG. 1C is an exploded perspective view of the roll holder of FIG. 1A.
Figure 1D:
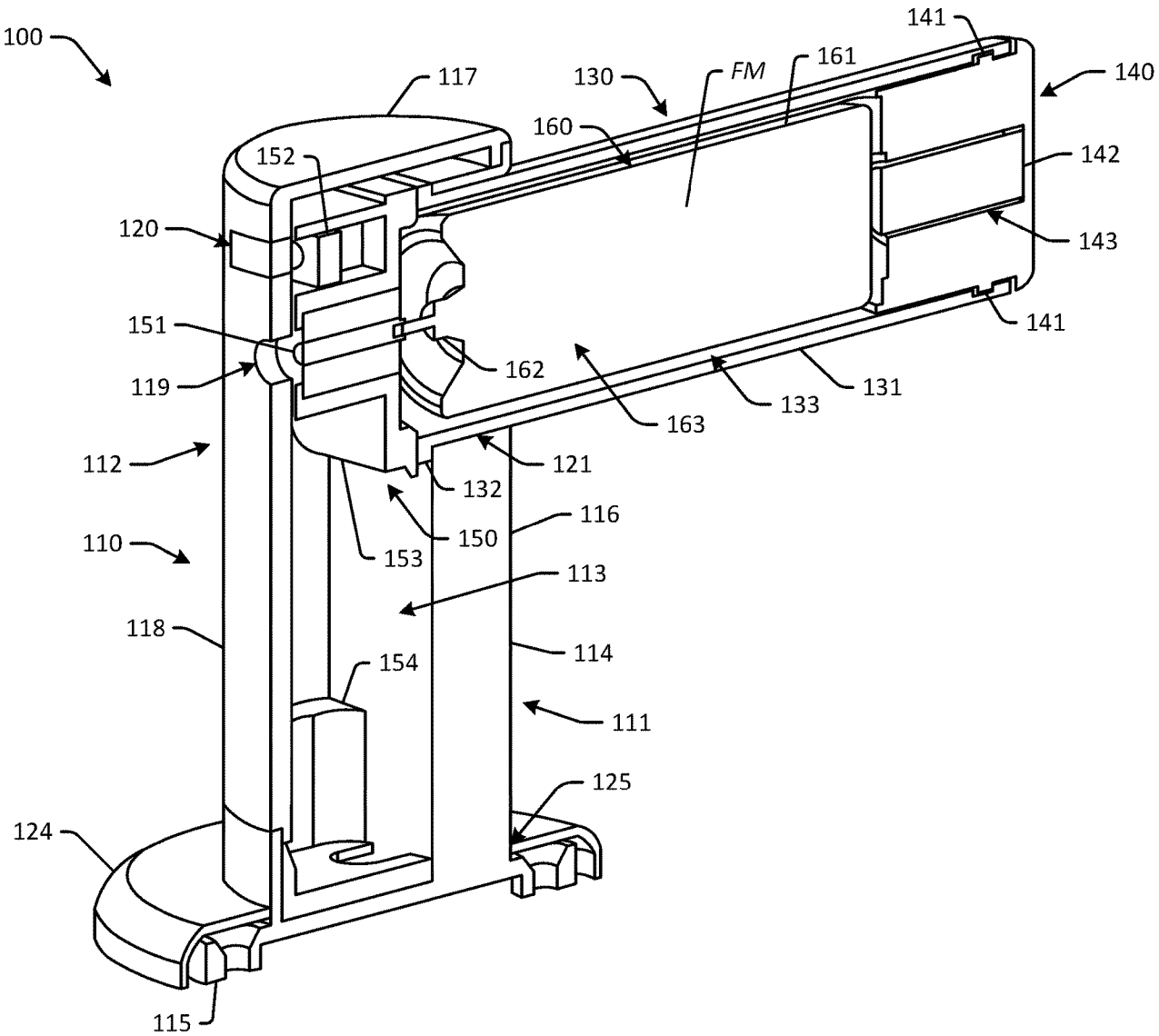
FIG. 1D is a cross-sectional perspective view of the roll holder of FIG. 1A.

As shown in FIGS. 1C and 1D, the flowable material container 160 may include a container body 161, a volume of flowable material FM positioned within the container body 161, and a container valve 162 positioned at one end of the container body 161. The flowable material container 160 may have an elongated shape defining a third longitudinal axis. For example, the container 160 may have a generally cylindrical shape, as shown, although other shapes may be used. The container body 161 may define an internal space 163 for containing the flowable material FM therein. The container valve 162 may be in fluid communication with the internal space 163 and configured to control release of the flowable material FM from the container body 161. The container 160 may be a pressurized container. For example, the container 160 may be a bag-on-valve container or an aerosol container. The container valve 162 may be positioned along the third longitudinal axis and axially actuated between an extended configuration (i.e., a closed configuration) preventing release of the flowable material FM and a retracted configuration (i.e., an open configuration) allowing release of the flowable material FM. For example, a valve stem of the container valve 162 may extend from the container body 161 and be actuated between an extended position and a retracted position. The container 160 may be positioned at least partially within the interior space 133 of the spindle 130. In some embodiments, the container 160 may be positioned entirely within the spindle 130. In other embodiments, a first portion of the container 160 may be positioned within the spindle 130, while a second portion of the container 160 may be positioned outside of the spindle 130 and within the interior space 113 of the support arm 110. For example, the container body 161 may be positioned within the spindle 130, and at least a portion of the container valve 162 may be positioned outside of the spindle 130 and within the support arm 110. As shown, the third longitudinal axis of the container 160 may extend coaxially with the second longitudinal axis of the spindle 130. Accordingly, the container 160 and the roll R of sheet product may be arranged in a concentric manner.

The flowable material dispensing mechanism 150 may be configured to dispense the flowable material FM from the container 160. In particular, the dispensing mechanism 150 may be an automated dispensing mechanism that is configured to carry out a dispense cycle upon detecting the presence of a user near the roll holder 100. The dispensing mechanism 150 may be positioned at least partially within the support arm 110. In some embodiments, as shown, the dispensing mechanism 150 may be positioned entirely within the support arm 110. As shown in FIGS. 1C and 1D, the flowable material dispensing mechanism 150 may include a solenoid valve 151 and a sensor 152 positioned within the interior space 113 of the support arm 110. The solenoid valve 151 may be in fluid communication with the container valve 162 and configured to receive the flowable material FM therefrom. In some embodiments, the container valve 162 may directly engage an inlet end of the solenoid valve 151. The solenoid valve 151 may have an elongated shape defining a fourth longitudinal axis. In some embodiments, as shown, the fourth longitudinal axis may extend coaxially with the second longitudinal axis. The solenoid valve 151 may be configured to move between an open configuration allowing the flowable material FM to pass through the solenoid valve 151 to an outlet end thereof and a closed configuration preventing the flowable material FM from passing therethrough. As shown, the outlet end of the solenoid valve 151 may be positioned within the support arm 110 and near but spaced apart from the dispensing opening 119. In this manner, the solenoid valve 151 may be protected from damage, and the support arm 110 may inhibit contamination of the valve 151. As shown, the dispensing opening 119 may be coaxial with the second longitudinal axis. In other words, the dispensing opening 119 may be positioned along the second longitudinal axis. In some embodiments, the flowable material FM may exit the outlet end of the solenoid valve 151 and pass directly through the dispensing opening 119 and out of the support arm 110, with the valve 151 providing a desired spray pattern. In other embodiments, a nozzle may be positioned at the outlet end of the valve 151 and configured to form a desired spray pattern. In some embodiments, such a nozzle may be positioned within the support arm 110 between the solenoid valve 151 and the dispensing opening 119. In other embodiments, such a nozzle may be formed as an integral part of the support arm 110, such as the cap portion 112 thereof, and the nozzle may define the dispensing opening 119.

The sensor 152 may be configured to detect the presence of a user within a predetermined distance from the sensor 152, for example, when the user holds a portion of sheet product near the dispensing opening 119. The sensor 152 may be an IR sensor, such as an IR optical sensor, a capacitive sensor, or other type of sensor for detecting the user's presence. The sensor 152 may be in operable communication with the solenoid valve 151 and configured to send a signal to the valve 151 indicating the presence of a user within the predetermined distance from the sensor 152. Upon receiving the signal, the solenoid valve 151 may move from the closed configuration to the open configuration, allowing the flowable material FW to be dispensed therefrom. The sensor 152 may be positioned within the support arm 110 near the sensor opening 120. In some embodiments, a sensor shield may be positioned within the opening 120 to protect the sensor 152. In other embodiments, the sensor opening 120 may be omitted, for example, when the sensor 152 is capable of operating through the support arm 110. In some embodiments, the solenoid valve 151 and the sensor 152 may be mounted to a housing 153 positioned within the support arm 110. The housing 153 may be configured to maintain alignment of the valve 151 and the sensor 152 with the dispensing opening 119 and the sensor opening 120, respectively.

The dispensing mechanism 150 also may include one or more batteries positioned within the support arm and in operable communication with the solenoid valve 151 and the sensor 152. In this manner, the batteries may provide electrical power for operation of the valve 151 and the sensor 152. Positioning of the batteries within the support arm 110 may be facilitated by a battery receiver 154. In some embodiments, the batteries may be positioned within a battery holster that is carried by the battery receiver 154. In other embodiments, the batteries may be positioned directly in the battery receiver 154. The batteries may be any type of battery suitable for powering the dispensing mechanism 150.

The flowable material container 160 may be loaded into the spindle 130 by removing the end cap 140, inserting the container 160 into the interior space 133, and reattaching the end cap 140 to the spindle 130. The end cap 140 and/or the compressible member may bias the container 160 into engagement with the dispensing mechanism 150. For example, the container valve 162 may engage the solenoid valve 151 such that the container valve 162 is moved to the retracted position. The solenoid valve 151 may receive the flowable material FM and control passage of the flowable material FM through the valve 151 and out of the support arm 110 via the dispensing opening 119. As described above, the solenoid valve 151 may be actuated (i.e., moved from the closed configuration to the open configuration and then back to the closed configuration) upon the sensor 152 detecting the presence of a user within a predetermined distance of the sensor 152. Actuation of the solenoid valve may be carried out by an electronic controller of the dispensing mechanism 150. The controller may be configured to maintain the valve 151 in the open position for a predetermined amount of time to allow the valve 151 to dispense a predetermined amount of the flowable material FM. Each actuation of the valve 151 may constitute a single dispense cycle of the dispensing mechanism 150. A user may initiate multiple dispense cycles, as needed, to obtain a desired amount of the flowable material FM on a portion of the sheet product.

The sheet product roll holder 100 may be mounted to a support structure in various orientations. For example, the roll holder 100 may be mounted such that the second longitudinal axis of the spindle 130 and the rotational axis of the roll R are in a horizontal orientation, as shown in FIG. 1A. In this manner, the flowable material FM may be dispensed from the roll holder 100 in a horizontal direction away from the roll R. Alternatively, the roll holder 100 may be mounted such that the second longitudinal axis of the spindle 130 and the rotational axis of the roll R are in a vertical orientation, as shown in FIG. 1B. In this manner, the flowable material FM may be dispensed from the roll holder 100 in a vertical direction away from the roll R.

Figure 2A:
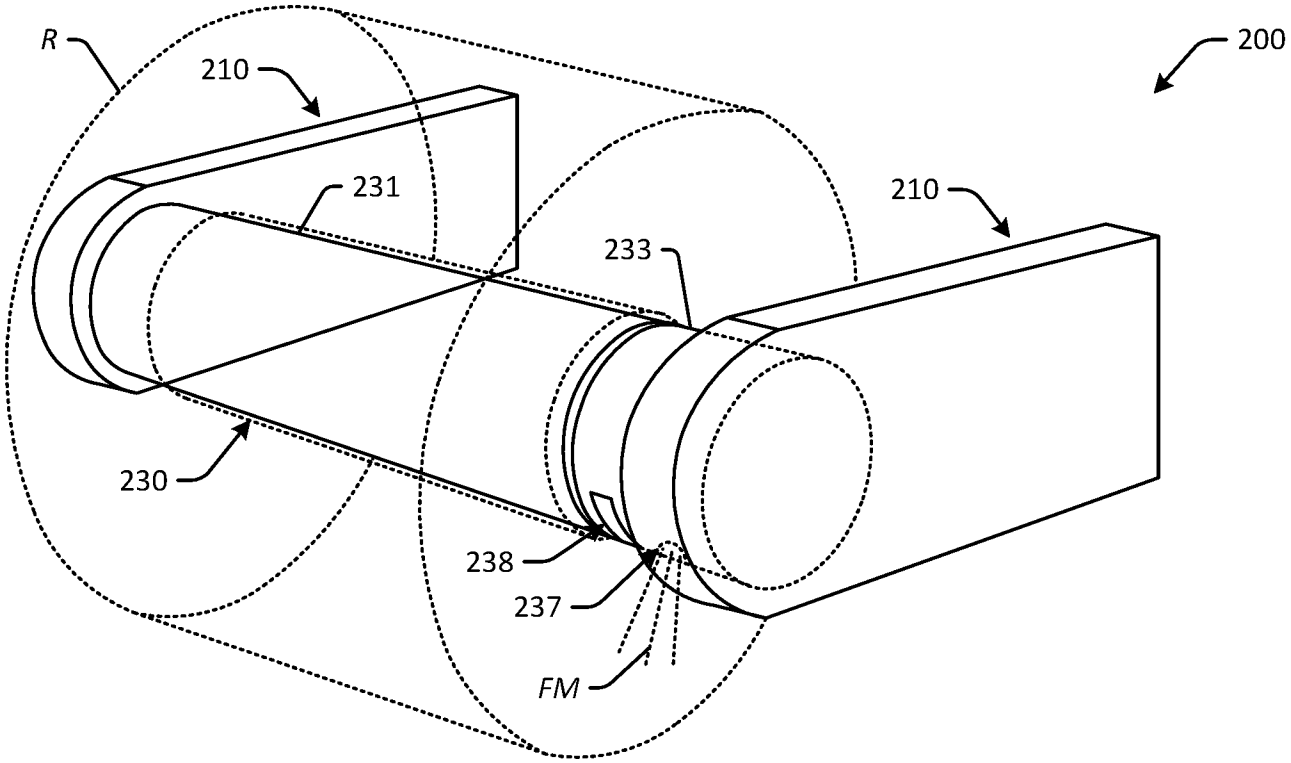
FIG. 2A is a perspective view of a sheet product roll holder having an integrated flowable material dispensing mechanism in accordance with one or more embodiments of the disclosure, showing a roll of sheet product supported by the roll holder.
Figure 2B:
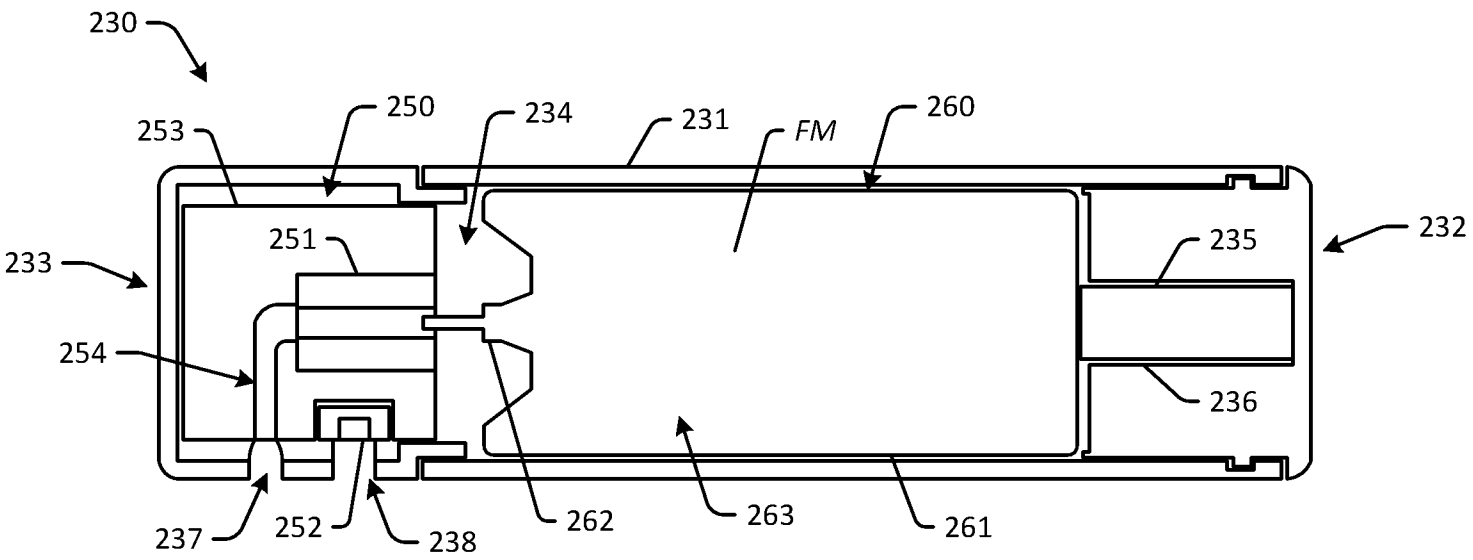
FIG. 2B is a cross-sectional plan view of a portion of the roll holder of FIG. 2A.

FIGS. 2A and 2B illustrate a sheet product roll holder 200 having an integrated flowable material dispensing mechanism. The roll holder 200 is configured to support a roll R of sheet product for removal therefrom and to dispense a flowable material FM. Certain similarities between the roll holder 200 and the roll holder 100 will be appreciated from the following description and the corresponding figures. In contrast to the roll holder 100, the roll holder 200 may include a flowable material container and a dispensing mechanism both positioned within a spindle of the roll holder 200, and a pair of support arms.

As shown, the sheet product roll holder 200 may include a pair of support arms 210, a spindle 230, a flowable material dispensing mechanism 250, and a flowable material container 260. The support arms 210 may be configured for mounting the roll holder 200 to a support structure and for supporting the other components of the roll holder 200. The support arms 210 may have an elongated shape defining parallel longitudinal axes. The spindle 230 may be configured to rotatably support the roll R of sheet product by extending through the central aperture of the roll R. As shown, the spindle 230 may be removably attached to the support arms 210 by engaging respective receptacles defined in the support arms 210. In some embodiments, one or both ends of the spindle 230 may be keyed to the respective support arms 210 to inhibit rotation of the spindle 230 relative to the support arms 210. The flowable material container 260 may be positioned within the spindle 230 and configured in the same manner as the container 160 described above. The flowable material dispensing mechanism 250 may be positioned within the spindle 230 and configured to dispense the flowable material FM from the flowable material container 260.

The spindle 230 may have an elongated shape defining a longitudinal axis extending transverse, such as perpendicular, to the longitudinal axes of the support arms 210. For example, the spindle 230 may have a generally cylindrical shape, as shown. The spindle 230 may include a tubular body 231, a first end cap 232 attached to one end of the tubular body 231, and a second end cap 233 attached to the other end of the tubular body 231. The end caps 232, 233 may be removably attached to the tubular body 231 by mating features such as protrusions and slots, mating threads, or other mechanisms. Alternatively, one of the end caps 232, 233 may be fixedly attached to or integrally formed with the tubular body 231, while the other of the end caps 232, 233 is removably attached to the body 231. The spindle 230 may define an interior space 234 therein, which is bounded by the tubular body 231 and the end caps 232, 233 and configured to receive the dispensing mechanism 250 and the flowable material container 260.

The first end cap 232 may be positioned at least partially within the interior space 234 of the spindle 230, such that the end cap 232 covers the respective end of the interior space 234 and the flowable material container 260 positioned therein. The first end cap 232 may facilitate positioning of the flowable material container 260 within the spindle 230, causing the container 260 to engage the dispensing mechanism 250. A compressible member 235, such as a compression spring, may be positioned between the first end cap 232 and the container 260 and configured to bias the container 260 toward the dispensing mechanism 250. The first end cap 232 may include a bore 236 that receives a portion of the compressible member 235 therein.

The second end cap 233 may be positioned at least partially within the interior space 234 of the spindle 230, such that the end cap 233 covers the respective end of the interior space 234 and the dispensing mechanism 250 positioned therein. The second end cap 233 may include one or more openings defined therein. For example, the second end cap 233 may include a dispensing opening 237 and a sensor opening 238. As shown, the dispensing opening 237 and the sensor opening 238 may be defined in a longitudinal side wall of the second end cap 233.

The flowable material dispensing mechanism 250 may be configured to dispense the flowable material FM from the container 260. In particular, the dispensing mechanism 250 may be an automated dispensing mechanism that is configured to carry out a dispense cycle upon detecting the presence of a user near the roll holder 200. The dispensing mechanism 250 may be positioned entirely within the spindle 230. As shown in FIG. 2B, the dispensing mechanism 250 may include a solenoid valve 251, a sensor 252, and a housing 253 positioned within the interior space 234. The solenoid valve 251 may be in fluid communication with the container valve 262 and configured to receive the flowable material FM therefrom. The solenoid valve 251 may be configured in the same manner as the solenoid valve 151 described above. The sensor 252 may be configured to detect the presence of a user within a predetermined distance from the sensor 252, for example, when the user holds a portion of sheet product near the dispensing opening 237. The sensor 252 may be configured in the same manner as the sensor 152 described above. As shown, the housing 253 may define an outlet passageway 254 extending from the outlet end of the solenoid valve 251 toward the dispensing opening 237 to direct the flowable material FM in a direction transverse to the longitudinal axis of the spindle 230. The dispensing mechanism 250 also may include one or more batteries positioned within the spindle 230 and in operable communication with the solenoid valve 251 and the sensor 252. For example, the batteries may be carried by the housing 253.

Figure 3A:
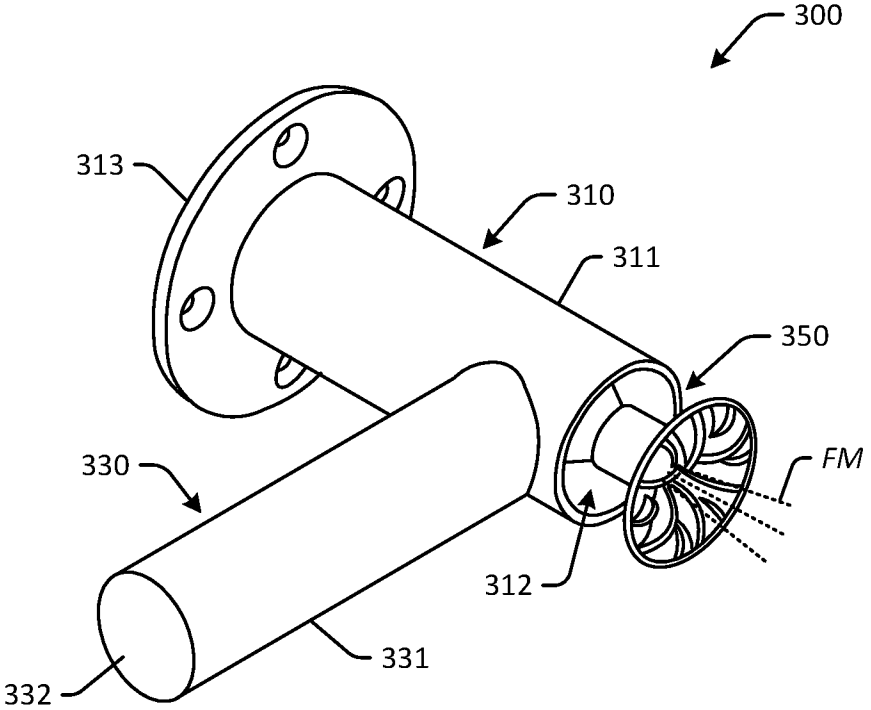
FIG. 3A is a perspective view of a sheet product roll holder having an integrated flowable material dispensing mechanism in accordance with one or more embodiments of the disclosure.
Figure 3B:
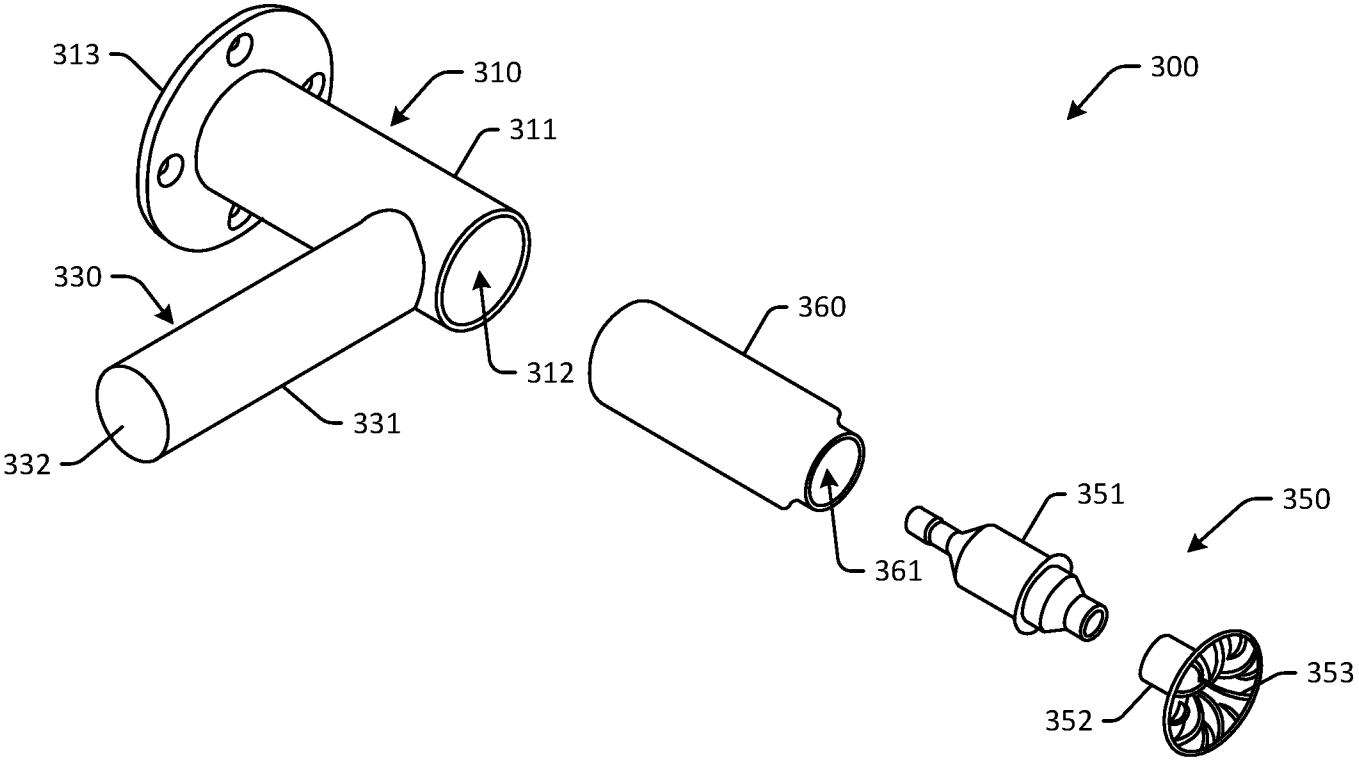
FIG. 3B is an exploded perspective view of the roll holder of FIG. 3A.

FIGS. 3A and 3B illustrate a sheet product roll holder 300 having an integrated flowable material dispensing mechanism. The roll holder 300 is configured to support a roll R of sheet product for removal therefrom and to dispense a flowable material FM. Certain similarities between the roll holder 300 and the roll holder 100 will be appreciated from the following description and the corresponding figures. In contrast to the roll holder 100, the roll holder 300 may include a flowable material container and a dispensing mechanism both positioned within a support arm of the roll holder 300.

As shown, the sheet product roll holder 300 may include a support arm 310, a spindle 330, a flowable material dispensing mechanism 350, and a flowable material container 360. The support arm 310 may be configured for mounting the roll holder 300 to a support structure and for supporting the other components of the roll holder 300. The support arm 310 may have an elongated shape defining a first longitudinal axis. As shown, the support arm 310 may include a tubular body 311 defining an interior space 312, and a flange 313 extending radially from the body 311. The spindle 330 may be configured to rotatably support the roll R of sheet product by extending through the central aperture of the roll R. As shown, the spindle 330 may be fixedly coupled to the support arm 310 or integrally formed therewith. The spindle 330 may have an elongated shape defining a second longitudinal axis extending transverse to, such as perpendicular to, the first longitudinal axis. The spindle 330 may include a tubular body 331 and a closed end wall 332. The flowable material container 360 may be formed as an elongated, hollow body defining an interior space 361 containing a volume of the flowable material FM therein. As shown, the container 360 may be positioned entirely within interior space 312 of the support arm 310.

The flowable material dispensing mechanism 350 may be configured to dispense the flowable material FM from the container 360. In particular, the dispensing mechanism 350 may be a manual dispensing mechanism that is configured to carry out a dispense cycle upon a user engaging and actuating the dispensing mechanism 350. The dispensing mechanism 350 may be positioned at least partially within the support arm 310. As shown in FIG. 3B, the dispensing mechanism 350 may include a displacement pump 351 and a nozzle 352. The displacement pump 351 may be configured to draw the flowable material FM from the container 360 and deliver the flowable material FM to the nozzle 352 upon actuation of the pump 351. In some embodiments, the displacement pump 351 may be a foaming displacement pump configured to convert the liquid flowable material FM into a foam. The pump 351 may be actuated in a linear manner along the longitudinal axis thereof. As shown, the inlet end of the pump 351 may be positioned within the container 360 and the outlet end may be in fluid communication with the nozzle 352. The nozzle 352 may be configured to distribute the flowable material FM in a desired pattern, for example, via a plurality of fins 353 of the nozzle 352. As shown, the displacement pump 351 may be positioned entirely within the support arm 310, while the nozzle 352 may be positioned partially within the support arm 310 and partially outside of the support arm 310.

The dispensing mechanism 350 may be actuated by a user pressing the nozzle 352 in the direction of the first longitudinal axis, for example, by pressing a portion of sheet product removed from the roll R against the nozzle 352. The linear movement of the nozzle 352 may actuate the displacement pump 351, moving the pump 351 from an extended configuration to a retracted configuration. The actuation of the pump 351 may deliver an amount of the flowable material FM to the nozzle 352 which disperses the flowable material FM onto the sheet product. As the user releases the nozzle 352, the pump 351 may move back to the extended configuration while drawing additional flowable material FM from the container 360 into the pump 351 for a subsequent dispense cycle.

Although the illustrated embodiment depicts the dispensing mechanism 350 as a manual dispensing mechanism, it will be appreciated that the dispensing mechanism 350 alternatively may be an automated dispensing mechanism similar to the dispensing mechanism 150 described above. In such embodiments, the automated dispensing mechanism may be positioned entirely within the support arm 310 along with a pressurized flowable material container.

FIGS. 4A-4H illustrate a sheet product roll holder 400 having an integrated flowable material dispensing mechanism. The sheet product roll holder 400 is configured to support a roll R of sheet product to allow a user to obtain a portion of sheet product therefrom. In some embodiments, the sheet product may be bath tissue, although other types of sheet product may be used with the roll holder 400. The sheet product roll holder 400 also is configured to dispense a flowable material FM to allow a user to apply the flowable material FM to a portion of sheet product removed from the roll R. In some embodiments, the flowable material FM may be a cleanser used for personal cleaning, although other types of flowable materials may be used. The flowable material FM may be provided in a flowable material container 460 of the roll holder 400, which may be replaced upon depletion of the flowable material FM. As described below, the container 460 may be disposed within the roll holder 400, such that the container 460 is protected from contamination and damage. Further, the container 460 may be arranged for convenient dispensing of the flowable material FM onto a portion of sheet product obtained from the roll R, while minimizing the overall size of the roll holder 400 and providing an aesthetically clean appearance. Certain similarities between the roll holder 400 and the roll holder 100 will be appreciated from the following description and the corresponding figures. In contrast to the roll holder 100, the roll holder 400 may include a mounting plate assembly configured for removably attaching a support arm and a spindle of the roll holder 400 to a support structure, such as a wall or a cabinet. Such removable attachment may facilitate replacement of batteries used to power the roll holder 400. The roll holder 400 also may include a capacitive touch sensor display for allowing a user to control dispensing of the flowable material FM from the roll holder 400 and for communicating information to the user. Additional differences between the roll holder 400 and the roll holder 100, including different configurations of similar components thereof, will be appreciated from following description and the corresponding figures.

As shown, the sheet product roll holder 400 may include a support arm 410, a spindle 430, an end cap 440, a flowable material dispensing mechanism 450, a flowable material container 460, a mounting plate assembly 470, and a battery carrier 490. The support arm 410 may be configured for supporting the spindle 430 and internal components of the roll holder 400 relative to a support structure to which the roll holder 400 is mounted. As described below, the support arm 410, the spindle 430, and the remaining components of the roll holder 400 may be removably mounted to a support structure, such as a wall or a cabinet, via the mounting plate assembly 470. The support arm 410 may have an elongated shape defining a first longitudinal axis. For example, the support arm 410 may have a generally cylindrical shape, as shown, although other shapes may be used. In some embodiments, the support arm 410 may include multiple components attached to one another. For example, the support arm 410 may include a base portion 411 and a cap portion 412 that are removably attached to one another. The support arm 410 may define an interior space 413 for containing the dispensing mechanism 450 therein. As shown, the interior space 413 may be defined by the base portion 411 and the cap portion 412. In other embodiments, the support arm 410 may be a unitary structure.

Figure 4A:
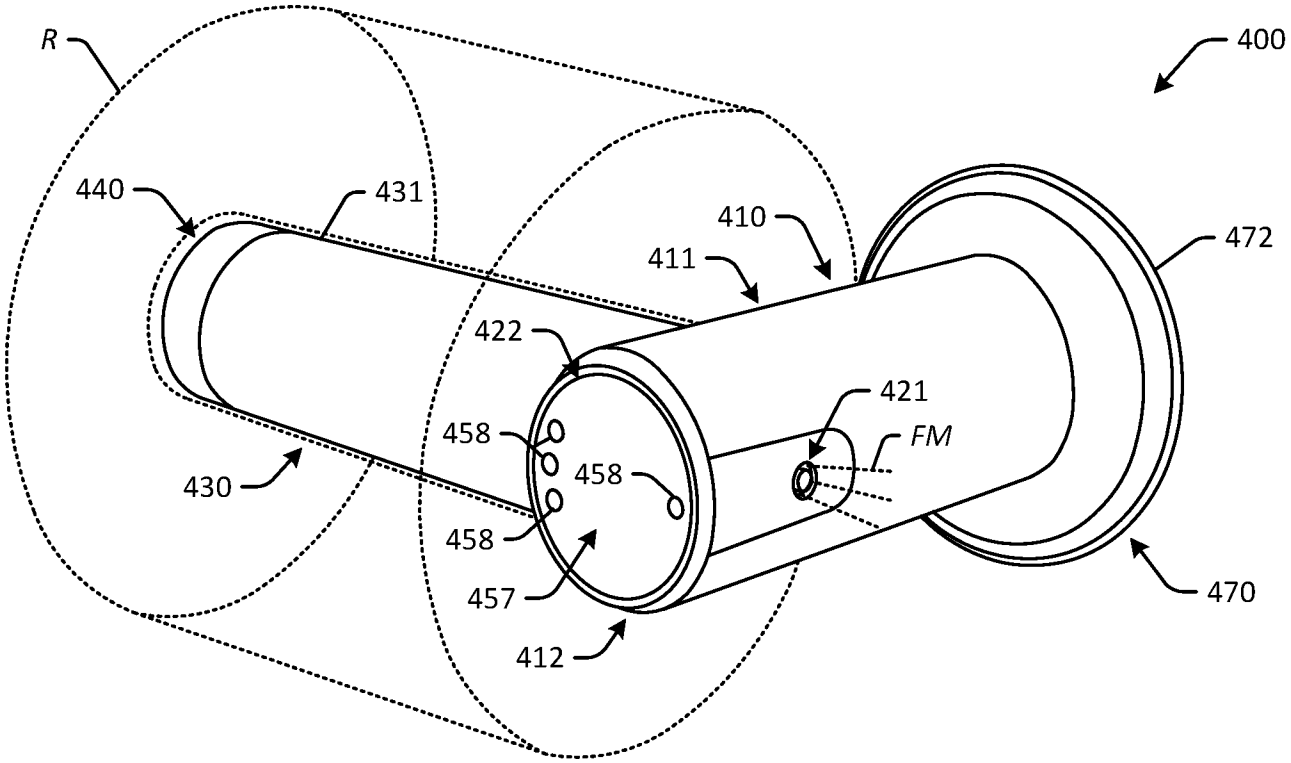
FIG. 4A is a perspective view of a sheet product roll holder having an integrated flowable material dispensing mechanism in accordance with one or more embodiments of the disclosure, showing a roll of sheet product supported by the roll holder in a horizontal orientation.
Figure 4B:
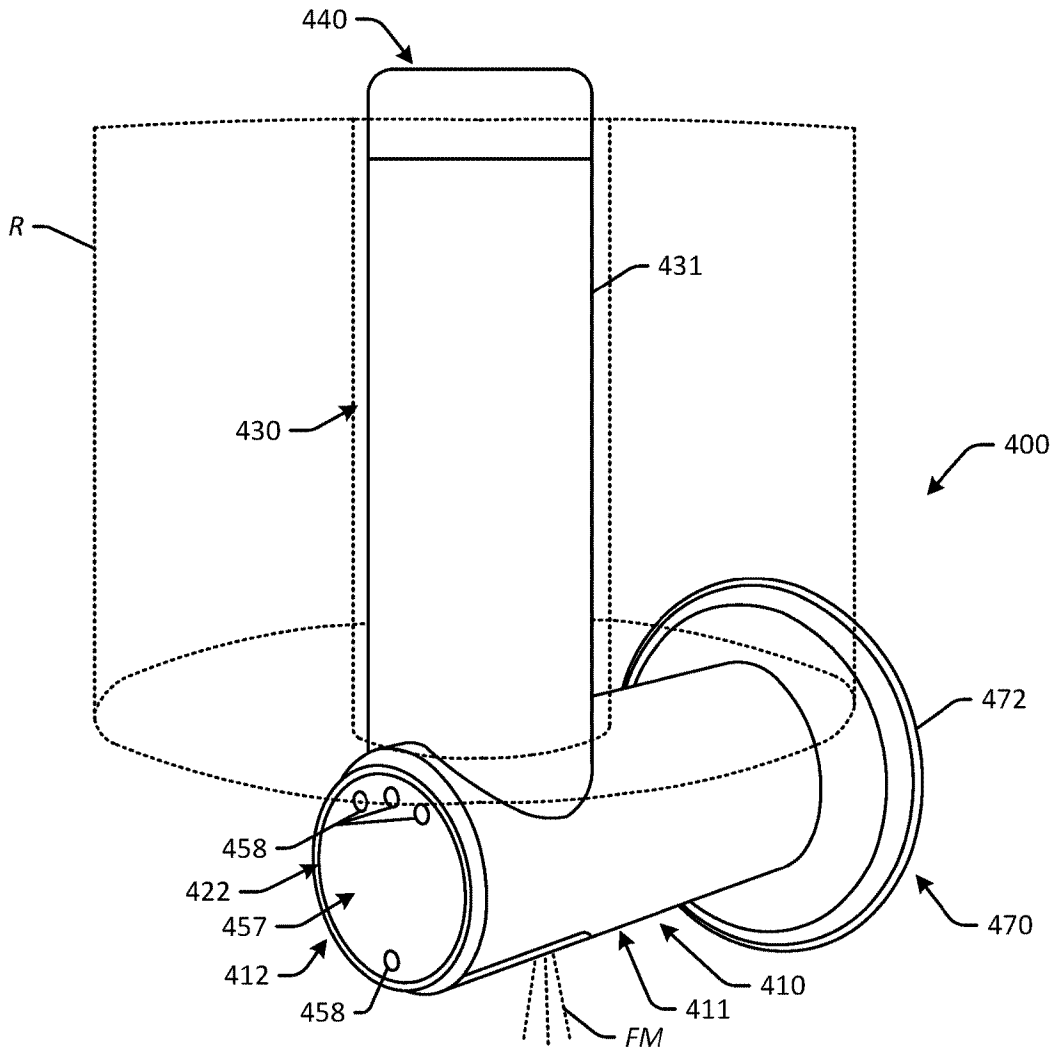
FIG. 4B is a perspective view of the roll holder of FIG. 4A, showing a roll of sheet product supported by the roll holder in a vertical orientation.

The base portion 411 may include an outer body 414 and an inner body 415 positioned at least partially within the outer body 414. The outer body 414 may define a portion of the interior space 413 and may have a tubular shape extending parallel to the first longitudinal axis. The inner body 415 may be positioned at least partially within the interior space 413 and may extend partially outside of the outer body 414 at one end thereof. The inner body 415 may have a longitudinal wall 416 extending parallel to the first longitudinal axis and an end wall 417 positioned at one end of the inner body 415. As shown in FIG. 4D, the inner body 415 may include a movable spring tab 418 configured to facilitate retention of the battery carrier 490 within the inner body 415. The cap portion 412 may include a longitudinal wall 419 and an end ring 420 each defining a portion of the interior space 413. In some embodiments, the base portion 411 and the cap portion 412 may be removably attached to one via a snap-fit connection, although other removable attachment mechanisms may be used. In this manner, the cap portion 412 may be removed from the base portion 411 to access the dispensing mechanism 450.

As shown, the support arm 410 may include one or more openings defined therein. For example, the support arm 410 may include a dispensing opening 421 and a sensor opening 422. In some embodiments, the dispensing opening 421 and the sensor opening 422 may be defined in the cap portion 412, although other arrangements of the openings may be used. As shown, the support arm 410 may include a one or more slots 423 defined therein and configured for removably engaging mating features of the mounting plate assembly 470. In some embodiments, the slots 423 each may have an L-shape and may be positioned along an end of the base portion 411. As shown, the slots 423 may be defined partially in the outer body 414 and partially in the inner body 415, although other arrangements of the slots 423 may be used.

The spindle 430 may be configured to rotatably support the roll R of sheet product thereon. In particular, the spindle 430 may be configured to extend through at least a portion of a central aperture of the roll R, such that the roll R may rotate around the spindle 430 for dispensing the sheet product. The spindle 430 may have an elongated shape defining a second longitudinal axis. For example, the spindle 430 may have a generally cylindrical shape, as shown, although other shapes may be used. The spindle 430 may include a tubular body 431 extending parallel to the second longitudinal axis. The spindle 430 may define an interior space 433 extending from one end to the other end of the spindle 430 and configured to receive the flowable material container 460. As shown, the spindle 430 may be coupled to the support arm 410. In some embodiments, as shown, the spindle 430 may be fixedly attached to the support arm 410, for example, by welding. In other embodiments, the spindle 430 may be integrally formed with the support arm 410. The second longitudinal axis of the spindle 430 may extend transverse to the first longitudinal axis of the support arm 410. For example, the second longitudinal axis may extend perpendicular to the first longitudinal axis, as shown.

The end cap 440 may be positioned at least partially within the interior space 433 of the spindle 430 at the free end thereof. In this manner, the end cap 440 may cover the free end of the interior space 433 and the flowable material container 460 positioned therein. The end cap 440 may be removably attached to the spindle 430. For example, the end cap 440 may include one or more locking protrusions 441 configured to engage mating internal slots in the spindle 430 to form a partial-turn locking mechanism. The end cap 440 may be removed, for example, to replace the flowable material container 460 upon depletion of the flowable material therein. The end cap 440 may facilitate positioning of the flowable material container 460 within the spindle 430, causing the container 460 to engage the dispensing mechanism 450, as described below. In some embodiments, a compressible member 442 may be positioned between the end cap 440 and the container 460 and configured to bias the container 460 toward the dispensing mechanism 450. The compressible member 442 may be a compression spring, although other types of compressible components may be used. The end cap 440 may include a bore 443 that receives a portion of the compressible member 442 therein.

Figure 4C:
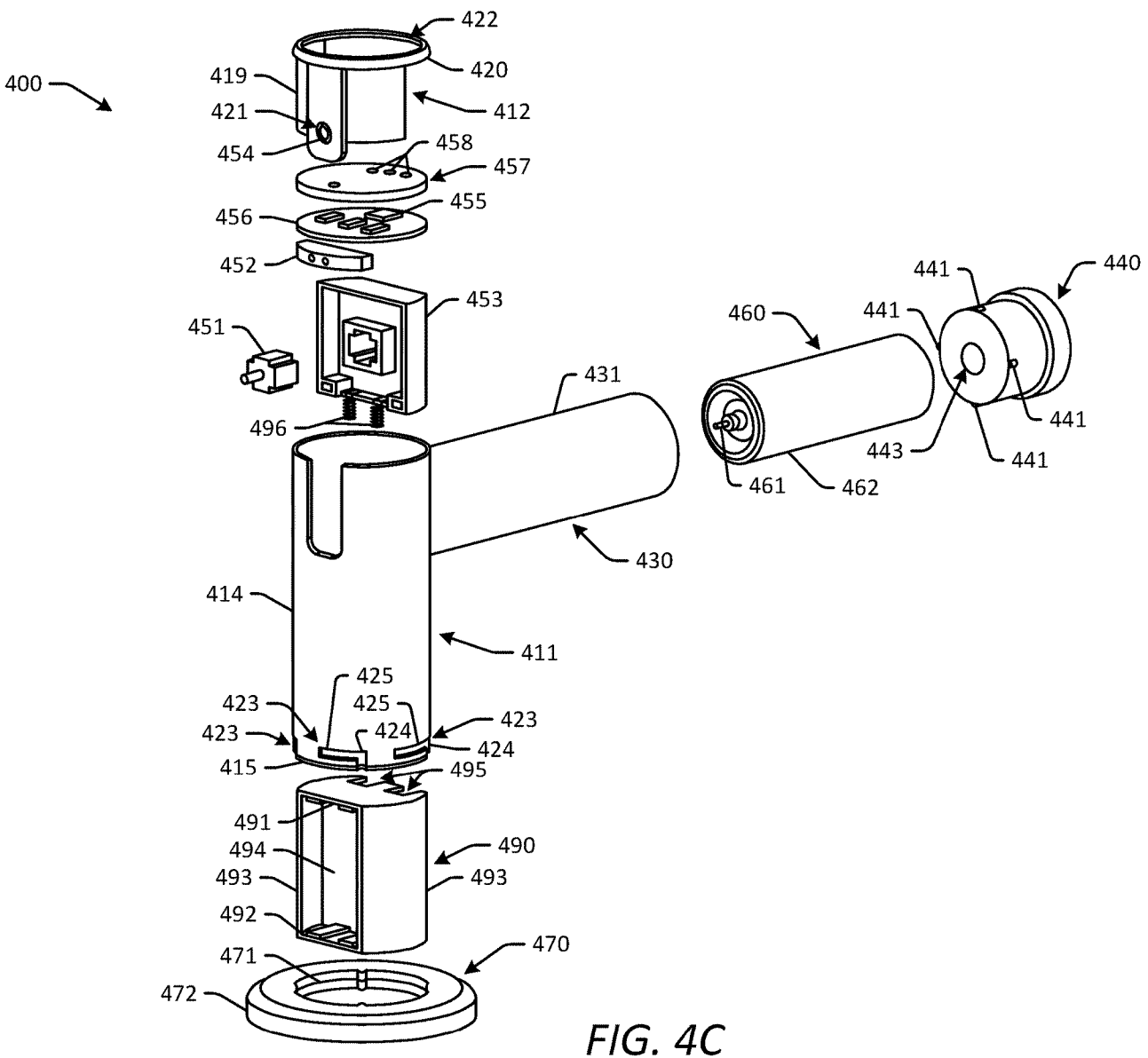
FIG. 4C is an exploded perspective view of the roll holder of FIG. 4A.
Figure 4D:
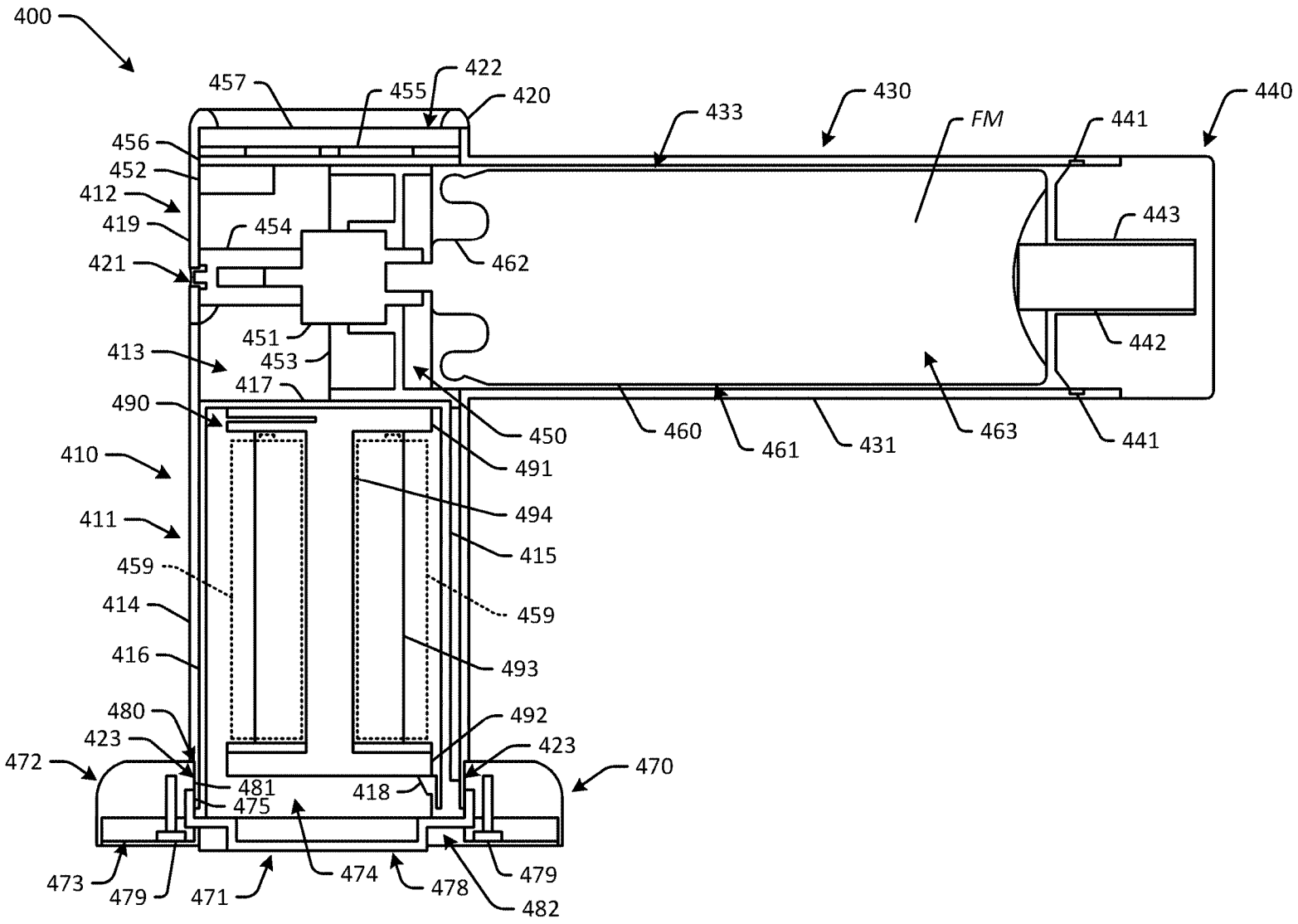
FIG. 4D is a cross-sectional plan view of the roll holder of FIG. 4A.
Figure 4E:
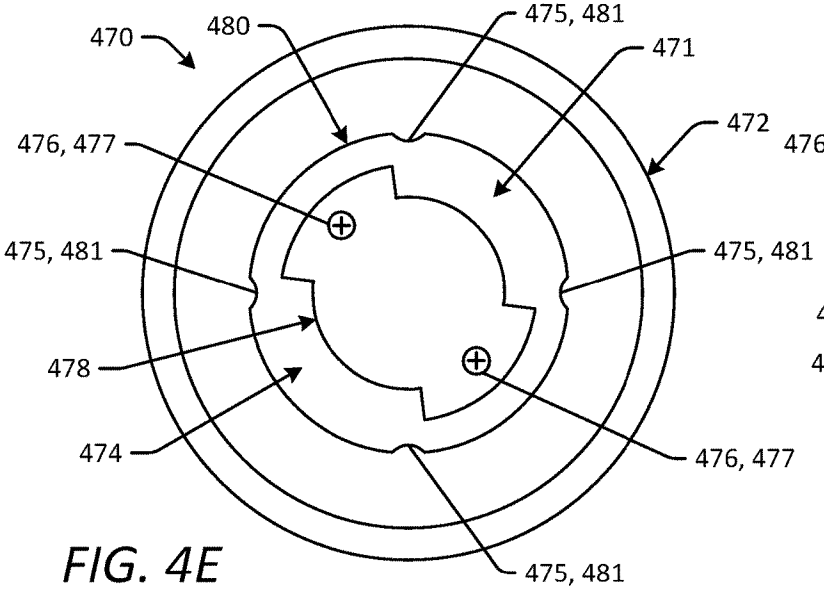
FIG. 4E is a front view of a mounting plate assembly of the roll holder of FIG. 4A, showing the mounting plate assembly in an unlocked configuration.

As shown in FIGS. 4C and 4D, the flowable material container 460 may include a container body 461, a volume of flowable material FM positioned within the container body 461, and a container valve 462 positioned at one end of the container body 461. The flowable material container 460 may have an elongated shape defining a third longitudinal axis. For example, the container 460 may have a generally cylindrical shape, as shown, although other shapes may be used. The container body 461 may define an internal space 463 for containing the flowable material FM therein. The container valve 462 may be in fluid communication with the internal space 463 and configured to control release of the flowable material FM from the container body 461. The container 460 may be a pressurized container. For example, the container 460 may be a bag-on-valve container or an aerosol container. The container valve 462 may be positioned along the third longitudinal axis and axially actuated between an extended configuration (i.e., a closed configuration) preventing release of the flowable material FM and a retracted configuration (i.e., an open configuration) allowing release of the flowable material FM. For example, a valve stem of the container valve 462 may extend from the container body 461 and be actuated between an extended position and a retracted position. The container 460 may be positioned at least partially within the interior space 433 of the spindle 430. In some embodiments, the container 460 may be positioned entirely within the spindle 430. In other embodiments, a first portion of the container 460 may be positioned within the spindle 430, while a second portion of the container 460 may be positioned outside of the spindle 430 and within the interior space 413 of the support arm 410. For example, at least a majority of the container body 461 may be positioned within the spindle 430, and at least a portion of the container valve 462 may be positioned outside of the spindle 430 and within the support arm 410. As shown, the third longitudinal axis of the container 460 may extend coaxially with the second longitudinal axis of the spindle 430. Accordingly, the container 460 and the roll R of sheet product may be arranged in a concentric manner.

The flowable material dispensing mechanism 450 may be configured to dispense the flowable material FM from the container 460. In particular, the dispensing mechanism 450 may be an automated dispensing mechanism that is configured to carry out a dispense cycle upon detecting the presence of a user near the roll holder 400. The dispensing mechanism 450 may be positioned at least partially within the support arm 410. In some embodiments, as shown, the dispensing mechanism 450 may be positioned entirely within the support arm 410. As shown in FIGS. 4C and 4D, the flowable material dispensing mechanism 450 may include a solenoid valve 451 and a sensor 452 positioned within the interior space 413 of the support arm 410. The solenoid valve 451 may be in fluid communication with the container valve 462 and configured to receive the flowable material FM therefrom. In some embodiments, the container valve 462 may directly engage an inlet end of the solenoid valve 451. The solenoid valve 451 may have an elongated shape defining a fourth longitudinal axis. In some embodiments, as shown, the fourth longitudinal axis may extend coaxially with the second longitudinal axis. The solenoid valve 451 may be configured to move between an open configuration allowing the flowable material FM to pass through the solenoid valve 451 to an outlet end thereof and a closed configuration preventing the flowable material FM from passing therethrough. As shown, the outlet end of the solenoid valve 451 may be positioned within the support arm 410 and near but spaced apart from the dispensing opening 421. In this manner, the solenoid valve 451 may be protected from damage, and the support arm 410 may inhibit contamination of the valve 451. As shown, the dispensing opening 421 may be coaxial with the second longitudinal axis. In other words, the dispensing opening 421 may be positioned along the second longitudinal axis. In some embodiments, the flowable material FM may exit the outlet end of the solenoid valve 451 and pass directly through the dispensing opening 421 and out of the support arm 410, with the valve 451 providing a desired spray pattern. In other embodiments, as shown, a nozzle 454 may be positioned at the outlet end of the valve 451 and configured to form a desired spray pattern. In some embodiments, the nozzle 454 may be positioned within the support arm 410 between the solenoid valve 451 and the dispensing opening 421. In other embodiments, the nozzle 454 may be formed as an integral part of the support arm 410, such as the cap portion 412 thereof, and the nozzle 454 may define the dispensing opening 421.

The sensor 452 may be configured to detect the presence of a user within a predetermined distance from the sensor 452, for example, when the user holds a portion of sheet product near the dispensing opening 421. The sensor 452 may be an IR sensor, such as an IR optical sensor, a capacitive sensor, or other type of sensor for detecting the user's presence. The sensor 452 may be in operable communication with the solenoid valve 451 and configured to send a signal to the valve 451 indicating the presence of a user within the predetermined distance from the sensor 452. Upon receiving the signal, the solenoid valve 451 may move from the closed configuration to the open configuration, allowing the flowable material FW to be dispensed therefrom. The sensor 452 may be positioned within the support arm 410 near the dispensing opening 421. In some embodiments, the sensor 452 may be positioned adjacent a sensor opening defined in the support arm 410, such as the cap portion 412 thereof. In other embodiments, as shown, such a sensor opening may be omitted, and the sensor 452 may be capable of operating through the support arm 410. In some embodiments, as shown, the solenoid valve 451 may be mounted to a housing 453 positioned within the support arm 410.

As shown in FIGS. 4C and 4D, the flowable material dispensing mechanism 450 also may include an electronic controller 455, a circuit board 456, and a capacitive touch sensor display 457. The electronic controller 455 may be configured for controlling dispensing of the flowable material FM from the roll holder 400. The electronic controller 455 may be mounted to the circuit board 456 and in operable communication with the solenoid valve 451, the sensor 452, and the capacitive touch sensor display 457. In this manner, the electronic controller 455 may receive a signal from the sensor 452 indicating the presence of a user and then send a signal to the solenoid valve 451 directing the solenoid valve 451 to carry out a dispense cycle. The capacitive touch sensor display 457 may be positioned adjacent the sensor opening 422, allowing a user to view and interact with the capacitive touch sensor display 457. As shown, the sensor 452 and the capacitive touch sensor display 457 may be mounted to the circuit board 456 or otherwise in communication with the controller 455. In some embodiments, as shown, the solenoid valve 451 and the circuit board 456 may be mounted to a housing 453 positioned within the support arm 410. The housing 453 may be configured to maintain alignment of the valve 451 and the capacitive touch sensor display 457 with the dispensing opening 421 and the sensor opening 422, respectively.

The capacitive touch sensor display 457 may be configured to present information to a user, such as a power state (e.g., an "on state" or an "off state") of the dispensing mechanism 450, a battery status (i.e., "remaining battery capacity") of batteries of the dispensing mechanism 450, a volume of the flowable material FM remaining in the container 460, an indication of a volume of the flowable material FM to be dispensed during a dispense cycle, and/or other information. In some embodiments, as shown, the capacitive touch sensor display 457 may include a plurality of light-emitting diodes (LEDs) 458 that are configured to emit light based on signals received from the electronic controller 455. In some embodiments, the capacitive touch sensor display 457 may allow a user to change a power state of the dispensing mechanism 450. For example, upon receiving a signal from the capacitive touch sensor display 457 indicating that a user has touched the display 457, the controller 455 may change the power state of the dispensing mechanism 450 from the off state to the on state or from the on state to the off state, depending on the existing state of the dispensing mechanism 450. In some embodiments, the controller 455 may include a timer and may be configured to cause the dispensing mechanism 450 to assume the off state after a predetermined period of time has elapsed following a most recent dispense cycle. The predetermined period of time may be five (5) minutes, one (1) minute, or another period of time. In such embodiments, after the predetermined period of time has elapsed and the dispensing mechanism 450 is in the off state, a user may need to touch the capacitive touch sensor display 457 to cause the controller 455 to change the power state of the dispensing mechanism 450 from the off state to the on state for dispensing of the flowable material. In some embodiments, the capacitive touch sensor display 457 may indicate a volume of the flowable material FM to be dispensed during a dispense cycle and may allow a user to change the volume by interacting with the display 457. For example, one or more of the LEDs 458 may indicate a volume of the flowable material FM to be dispensed, and a user may adjust (i.e., increase or decrease) the volume per dispense cycle by touching one or more portions of the capacitive touch sensor display 457.

As shown in FIG. 4D, the dispensing mechanism 450 also may include one or more batteries 459 (illustrated via dashes lines) positioned within the support arm 410 and in operable communication with the solenoid valve 451, the sensor 452, the electronic controller 455, the circuit board 456, and the capacitive touch sensor display 457. In this manner, the batteries 459 may provide electrical power for operation of these components. Positioning of the batteries 459 within the support arm 410 may be facilitated by the battery carrier 490. As shown in FIGS. 4D and 4C, the battery carrier 490 may be configured to receive a plurality of batteries 459 within respective receptacles. For example, four (4) AA batteries 459 may be positioned within the battery carrier 490, although any number and other types of batteries may be used. The battery carrier 490 may include a first end wall 491, a second end wall 492, a pair of side walls 493, and an intermediate wall 494. As shown, the battery carrier 490 may be removably received within the support arm 410, in particular, within the inner body 415 of the base portion 411. The battery carrier 490 may be inserted and removed when the support arm 410 is removed from the mounting plate assembly 470, as described below. When the battery carrier 490 is positioned within the support arm 410, the spring tab 418 may engage the second end wall 492, as shown in FIG. 4D, to maintain the carrier 490 in a secure manner against the end wall 417 of the inner body 415. However, the spring tab 418 may be resiliently deflected to disengage the second end wall 492 and allow removal of the battery carrier 490 from the inner body 415. As shown, the battery carrier 490 may include one or more apertures 495 defined in the first end wall 491 and configured to allow one or more battery contacts 496 to extend therethrough. The battery contacts 496 may be attached to the housing 453 and in electrical communication with the circuit board 456 and the controller 455. When the battery carrier 490 is positioned within the support arm 410, the battery contacts 496 may engage respective batteries 459 received therein. In some embodiments, as shown, the battery contacts 496 may be formed as spring contacts, although other configurations may be used. When the spring tab 418 is disengaged from the second end wall 492, the battery contacts 496 may bias the engaged batteries 459 away from the housing 453, thereby facilitating removal of the battery carrier 490 from the inner body 415.

As shown in FIGS. 4C-4H, the mounting plate assembly 470 may include a mounting plate 471, a front cover 472, and a back cover 473 attached to one another. The mounting plate 471 may be formed as a contoured plate configured to receive an end portion of the support arm 410 therein when the support arm 410 is attached to the mounting plate assembly 470. The mounting plate 471 may include a receptacle 474 for receiving the end portion of the support arm 410. As shown, the receptacle 474 may have a generally circular shape with one or more protrusions 475 extending radially inward toward a central axis of the mounting plate assembly 470. As described below, the protrusions 475 may be configured to engage and be received within the respective slots 423 of the support arm 410. The mounting plate 471 also may include one or more apertures 476 defined therein and configured to receive respective fasteners 477, such as screws, for attaching the mounting plate assembly 470 to a support structure. The mounting plate 471 further may include a recessed portion 478 having a contoured shape configured to engage mating portions of the back cover 473, as described below. In some embodiments, as shown, the recessed portion 478 may include a central, circular region and a pair of arcuate ear regions extending radially outward from the circular region.

Figure 4F:
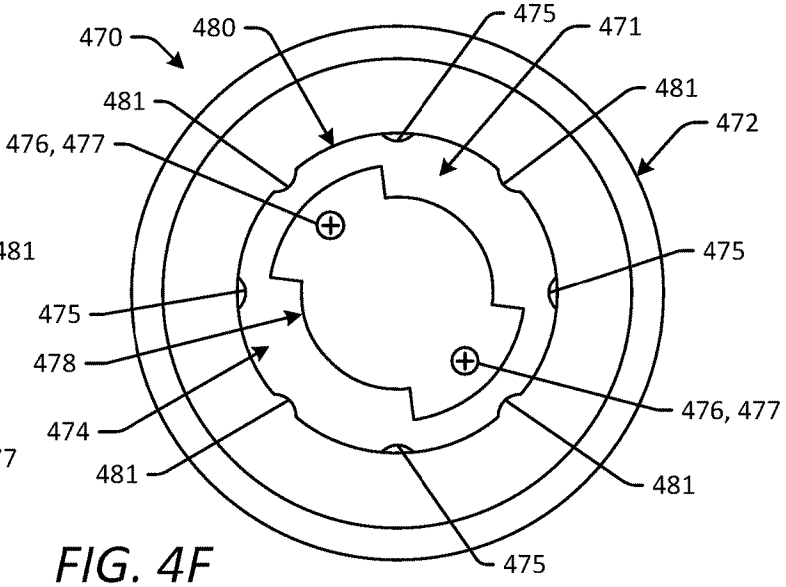
FIG. 4F is a front view of the mounting plate assembly of the roll holder of FIG. 4A, showing the mounting plate assembly in a locked configuration.
Figure 4G:
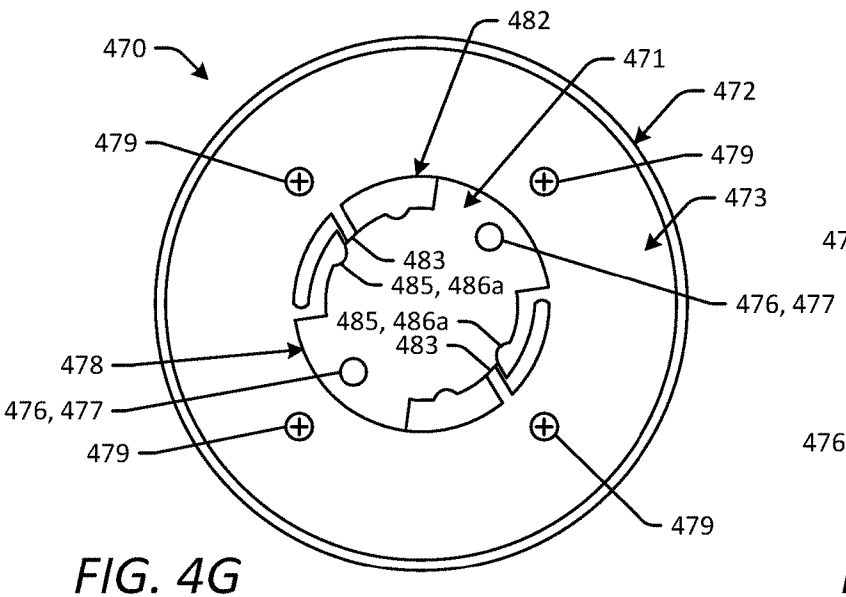
FIG. 4G is a back view of the mounting plate assembly of the roll holder of FIG. 4A, showing the mounting plate assembly in the unlocked configuration.
Figure 4H:
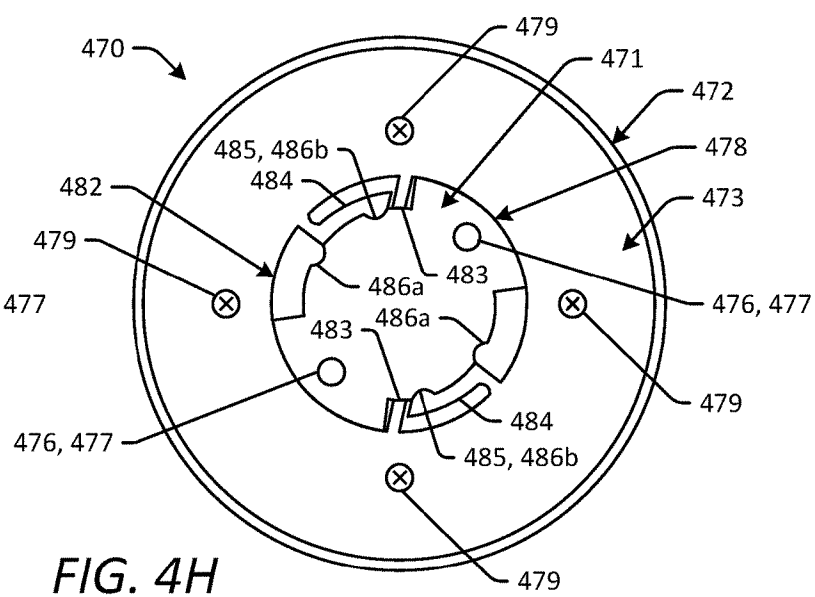
FIG. 4H is a back view of the mounting plate assembly of the roll holder of FIG. 4A, showing the mounting plate assembly in the locked configuration.

The front cover 472 and the back cover 473 may be formed as ring-shaped members positioned along the front side and the back side of the mounting plate 471, respectively. The front cover 472 and the back cover 473 may be fixedly attached to one another and coupled to the mounting plate 471 such that the covers 472, 473 are configured to rotate relative to the mounting plate 471 about the central axis of the mounting plate assembly 470. In particular, the covers 472, 473 may be configured to rotate relative to the mounting plate 471 between an unlocked position, as shown in FIGS. 4C-4E and 4G, and a locked position, as shown in FIGS. 4F and 4H. According to the illustrated embodiment, the front cover 472 and the back cover 473 may be attached to one another by one or more fasteners 479, such as screws, extending through respective apertures of the covers 472, 473, although other means of attachment may be used. The front cover 472 may include a central aperture 480 for receiving the end portion of the support arm 410. As shown, the central aperture 480 may have a generally circular shape with one or more protrusions 481 extending radially inward toward the central axis of the mounting plate assembly 470.

As described below, the protrusions 481 may be configured to engage and be received within the respective slots 423 of the support arm 410. As shown, the shape and size of the central aperture 480 and the protrusions 481 may correspond to the shape and size of the receptacle 474 and the protrusions 475 of the mounting plate 471.

The back cover 473 may include a central aperture 482 for receiving the recessed portion 478 of the mounting plate 471. As shown, the central aperture 482 may have a generally circular shape with one or more protrusions 483 extending radially inward toward the central axis of the mounting plate assembly 470. As described below, the protrusions 483 may be configured to engage the respective ear regions of the recessed portion 478 of the mounting plate 471 to limit rotation of the covers 472, 473 relative to the mounting plate 471. The back cover 473 also may include one or more spring arms 484 extending inward toward and circumferentially around the central axis of the mounting plate assembly 470. Each spring arm 484 may include a tab 485 positioned at or near a free end of the spring arm 484 and configured to selectively engage mating recesses 486 defined in the recessed portion 478 of the mounting plate 471. As shown, the recessed portion 478 may include a pair of first recesses 486*a* and a pair of second recesses 486*b* defined on the back side of the mounting plate 471 along the circular region of the recessed portion 478.

Attachment of the support arm 410 to the mounting plate assembly 470 may be facilitated by the slots 423 of the support arm 410, the protrusions 475 of the mounting plate 471, and the protrusions 481 of the front cover 472. As described above, the slots 423 may be configured to receive the protrusions 475, 481 therein. As shown, each slot 423 may have an L-shaped configuration, with a longitudinal leg 424 of the slot 423 extending parallel to the first longitudinal axis and a circumferential leg 425 of the slot 423 extending circumferentially about the first longitudinal axis. When the mounting plate assembly 470 is in the unlocked configuration, as shown in FIGS. 4C-4E and 4G, the protrusions 475 of the mounting plate 471 may be aligned with the protrusions 481 of the front cover 472, and the tabs 485 of the spring arms 484 may engage the respective first recesses 486*a*. With the mounting plate assembly 470 in the unlocked configuration, the end portion of the support arm 410 may be inserted into the receptacle 474 of the mounting plate 471 and the central aperture 480 of the front cover 462 such that the protrusions 475, 481 are received within the respective slots 423. The mounting plate assembly 470 then may be moved from the unlocked configuration to the locked configuration by rotating the front cover 472 and the back cover 473 relative to the mounting plate 471. When the mounting plate assembly 470 is in the locked configuration, as shown in FIGS. 4F and 4H, the protrusions 475 of the mounting plate 471 may be circumferentially offset from the protrusions 481 of the front cover 472, and the tabs 485 of the spring arms 484 may engage the respective second recesses 486*b*. When the mounting plate assembly 470 is in the locked configuration, the protrusions 475 of the mounting plate 471 may be positioned within the longitudinal legs 424 of the respective slots 423 near the open ends thereof, and the protrusions 481 of the front cover 472 may be positioned within the circumferential legs 425 of the respective slots 423 near the closed ends thereof. As a result, the engagement between the slots 423 and the protrusions 475, 481 may securely attach the support arm 410 to the mounting plate assembly 470. When removal of the support arm 410 from the mounting plate assembly 470 is desired, for example, to replace the batteries 459, the mounting plate assembly 470 may be moved from the locked configuration to the unlocked configuration by rotating the front cover 472 and the back cover 473 in the opposite direction relative to the mounting plate 471.

The flowable material container 460 may be loaded into the spindle 430 by removing the end cap 440, inserting the container 460 into the interior space 433, and reattaching the end cap 440 to the spindle 430. The end cap 440 and/or the compressible member 442 may bias the container 460 into engagement with the dispensing mechanism 450. For example, the container valve 462 may engage the solenoid valve 451 such that the container valve 462 is moved to the retracted position. The solenoid valve 451 may receive the flowable material FM and control passage of the flowable material FM through the valve 451 and out of the support arm 410 via the dispensing opening 421. As described above, the solenoid valve 451 may be actuated (i.e., moved from the closed configuration to the open configuration and then back to the closed configuration) upon the sensor 452 detecting the presence of a user within a predetermined distance of the sensor 452. Actuation of the solenoid valve 451 may be caused by the electronic controller 455 in response to receiving a signal from the sensor 452 indicating the presence of the user. The controller may be configured to maintain the valve 451 in the open position for a predetermined amount of time to allow the valve 451 to dispense a predetermined amount of the flowable material FM. Each actuation of the valve 451 may constitute a single dispense cycle of the dispensing mechanism 450. A user may initiate multiple dispense cycles, as needed, to obtain a desired amount of the flowable material FM on a portion of the sheet product.

The sheet product roll holder 400 may be mounted to a support structure in various orientations. For example, the roll holder 400 may be mounted such that the second longitudinal axis of the spindle 430 and the rotational axis of the roll R are in a horizontal orientation, as shown in FIG. 4A. In this manner, the flowable material FM may be dispensed from the roll holder 400 in a horizontal direction away from the roll R. Alternatively, the roll holder 400 may be mounted such that the second longitudinal axis of the spindle 430 and the rotational axis of the roll R are in a vertical orientation, as shown in FIG. 4B. In this manner, the flowable material FM may be dispensed from the roll holder 400 in a vertical direction away from the roll R.

The sheet product roll holders described herein may be mounted to or incorporated into various support structures, which may be stationary or mobile, for convenient dispensing of sheet product and flowable material. In certain embodiments, the roll holders may be mounted to or incorporated into a wall of a building, a cabinet of a building, an arm rest in an auditorium, a toilet of a restroom, a stall of a public restroom, such as a door or a door handle thereof, an appliance of a kitchen, such as a refrigerator or an oven thereof, a wheelchair, a stroller, a shopping cart, or a bicycle.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific automated product dispenser configurations, it will be appreciated that numerous other automated product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A sheet product roll holder for supporting a roll of sheet product, the sheet product roll holder comprising:

a support arm having an elongated shape defining a first longitudinal axis, the support arm comprising a first end, a second end, a side surface extending between the first end and the second end, and a dispensing opening disposed on a first portion of the side surface;

a spindle coupled to a second portion of the side surface of the support arm, the spindle having an elongated shape defining a second longitudinal axis extending transverse to the first longitudinal axis, wherein the spindle is configured to rotatably support the roll of sheet product;

a flowable material container positioned at least partially within the spindle and having an elongated shape defining a third longitudinal axis extending coaxially with the second longitudinal axis, the flowable material container comprising a container body in which a volume of a flowable material can be stored; and an automated flowable material dispensing mechanism positioned at least partially within the support arm.

2. The sheet product roll holder of claim 1, wherein the flowable material container is a pressurized container, and wherein the flowable material container further comprises a container valve configured to control release of the flowable material from the container body.

3. The sheet product roll holder of claim 2, wherein the automated flowable material dispensing mechanism comprises a solenoid valve positioned within the support arm and in fluid communication with the container valve, the solenoid valve configured to control dispensing of the flowable material from the sheet product roll holder.

4. The sheet product roll holder of claim 3, wherein the solenoid valve has an elongated shape defining a fourth longitudinal axis extending coaxially with the second longitudinal axis.

5. The sheet product roll holder of claim 3, wherein the automated flowable material dispensing mechanism further comprises:

a sensor positioned within the support arm and configured to detect the presence of an object within a predetermined distance from the sensor; and an electronic controller positioned within the support arm and in operable communication with the solenoid valve and the sensor.

6. The sheet product roll holder of claim 5, wherein the electronic controller is configured to:

receive a signal from the sensor indicating the presence of the user within the predetermined distance from the sensor; and direct the solenoid valve to move from a closed configuration to an open configuration upon receiving the signal from the sensor.

7. The sheet product roll holder of claim 5, wherein the automated flowable material dispensing mechanism further comprises one or more batteries positioned within the support arm and in operable communication with the solenoid valve, the sensor, and the electronic controller.

8. The sheet product roll holder of claim 5, wherein the automated flowable material dispensing mechanism further comprises a capacitive touch sensor display positioned within the support arm and in operable communication with the electronic controller, the capacitive touch sensor display configured to present information to the user and to detect a touch of the user.

9. The sheet product roll holder of claim 8, wherein the electronic controller is configured to:

cause the automated flowable material dispensing mechanism to assume an off state after a predetermined period of time has elapsed following a most recent dispense cycle;

receive a signal from the capacitive touch sensor display indicating the touch of the user; and cause the automated flowable material dispensing mechanism to assume an on state upon receiving the signal from the capacitive touch sensor display.

10. The sheet product roll holder of claim 1, wherein the first end is closer to a wall mount than the second end, wherein the dispensing opening is closer to the first end than the second end, and wherein the dispensing opening is coaxial with the second longitudinal axis.

11. The sheet product roll holder of claim 10, wherein the automated flowable material dispensing mechanism is positioned between the flowable material container and the dispensing opening in the direction of the second longitudinal axis.

12. The sheet product roll holder of claim 1, wherein the automated flowable material dispensing mechanism is positioned entirely within the support arm.

13. The sheet product roll holder of claim 1, wherein the second longitudinal axis extends perpendicular to the first longitudinal axis.

14. The sheet product roll holder of claim 1, wherein the flowable material container is positioned entirely within the spindle.

15. The sheet product roll holder of claim 1, wherein a first portion of the flowable material container is positioned within the spindle, and wherein a second portion of the flowable material container is positioned within the support arm.

16. The sheet product roll holder of claim 1, wherein the support arm, the spindle, and the flowable material container each have a cylindrical shape.

17. The sheet product roll holder of claim 1, wherein the support arm comprises a base portion and a cap portion removably attached to one another and defining an interior space therebetween.

18. The sheet product roll holder of claim 1, further comprising a mounting plate assembly configured for mounting the sheet product roll holder to a support structure, wherein the support arm is removably attached to the mounting plate assembly.

19. The sheet product roll holder of claim 18, wherein the mounting plate assembly comprises:

a mounting plate comprising a plurality of first protrusions configured to engage the support arm; and a cover coupled to the mounting plate and configured to rotate relative to the mounting plate between an unlocked position and a locked position, the cover comprising a plurality of second protrusions configured to engage the support arm.

20. The sheet product roll holder of claim 19, wherein the support arm comprises a plurality of slots each configured to receive one of the first protrusions and one of the second protrusions when the support arm is attached to the mounting plate assembly, wherein the first protrusions and the second protrusions are aligned with one another when the mounting plate is in the unlocked position, and wherein the first protrusions and the second protrusions are offset from one another when the mounting plate is in the locked position.

21. A sheet product roll holder for supporting a roll of sheet product, the sheet product roll holder comprising:

a first support arm having an elongated shape defining a first longitudinal axis, the first support arm comprising a first side surface extending between a first end and a second end, and a dispensing opening disposed on a first portion of the first side surface;

a second support arm having an elongated shape defining a second longitudinal axis, the second support arm comprising a second side surface extending between a first end and a second end;

a spindle coupled to a second portion of the first side surface of the first support arm and the second side surface of the second support arm, the spindle having an elongated shape defining a third longitudinal axis extending transverse to each of the first longitudinal axis and the second longitudinal axis, the spindle configured to rotatably support the roll of sheet product;

a flowable material container positioned within the spindle, the flowable material container comprising a container body in which a volume of a flowable material can be stored; and an automated flowable material dispensing mechanism positioned within the spindle.

22. The sheet product roll holder of claim 21, wherein the automated flowable material dispensing mechanism comprises:

a solenoid valve in fluid communication with the flowable material container and configured to control dispensing of the flowable material from the sheet product roll holder;

a sensor positioned in operable communication with the solenoid valve and configured to detect the presence of a user within a predetermined distance from the sensor; and one or more batteries in operable communication with the solenoid valve and the sensor.

23. The sheet product roll holder of claim 21, wherein the dispensing opening extends transverse to the third longitudinal axis.

24. A sheet product roll holder for supporting a roll of sheet product, the sheet product roll holder comprising:

a support arm having an elongated shape defining a first longitudinal axis, the support arm configured for mounting the sheet product roll holder to a support structure, the support arm comprising a first end, a second end, a side surface extending between the first end and the second end, and a dispensing opening disposed on a first portion of the side surface;

a spindle coupled to a second portion of the side surface of the support arm, the spindle having an elongated shape defining a second longitudinal axis extending transverse to the first longitudinal axis, wherein the spindle is configured to rotatably support the roll of sheet product;

a flowable material container positioned within the support arm and having an elongated shape defining a third longitudinal axis extending coaxially with the first longitudinal axis, the flowable material container comprising a container body in which a volume of a flowable material can be stored; and a flowable material dispensing mechanism positioned at least partially within the support arm.

25. The sheet product roll holder of claim 24, wherein the flowable material dispensing mechanism comprises:

a pump positioned within the support arm and configured to draw the flowable material from the container body; and a nozzle in fluid communication with the pump and extending outside of the support arm.

* * * * *